US012709896B2

(12) United States Patent
Nagarajan et al.

(10) Patent No.: US 12,709,896 B2
(45) Date of Patent: Aug. 18, 2026

(54) ROOFING SYSTEM

(71) Applicant: BMIC LLC, Dallas, TX (US)

(72) Inventors: Venkata S. Nagarajan, Hawthorn Woods, IL (US); Jui-Hsiang Hung, Horseheads, NY (US); Adith Sujan, Mechanicsburg, PA (US)

(73) Assignee: BMIC LLC, Dallas, TX (US)

( * ) Notice: Subject to any disclaimer, the term of this patent is extended or adjusted under 35 U.S.C. 154(b) by 229 days.

(21) Appl. No.: 18/421,307

(22) Filed: Jan. 24, 2024

(65) Prior Publication Data

US 2024/0392570 A1 Nov. 28, 2024

Related U.S. Application Data

(60) Provisional application No. 63/468,299, filed on May 23, 2023.

(51) Int. Cl.
*E04D 11/02* (2006.01)
*E04D 13/00* (2006.01)

(52) U.S. Cl.
CPC ..... *E04D 11/02* (2013.01); *E04D 13/006* (2013.01)

(58) Field of Classification Search
CPC ..... E04D 11/02; E04D 13/006; E04D 13/16
See application file for complete search history.

(56) References Cited

U.S. PATENT DOCUMENTS 2,616,283 A 11/1952 Branstrator et al.
4,021,981 A 5/1977 Van Wagoner
4,235,058 A 11/1980 Patry
4,329,827 A 5/1982 Thorn
4,357,377 A * 11/1982 Yamamoto ..... B32B 5/16 428/920
4,464,215 A 8/1984 Cogliano
4,764,420 A 8/1988 Gluck et al.
4,775,567 A 10/1988 Harkness
5,053,274 A 10/1991 Janas
5,106,668 A 4/1992 Turner et al.
5,571,596 A 11/1996 Johnson
5,625,999 A 5/1997 Buzza et al.
5,714,226 A 2/1998 Disselbeck
5,958,549 A 9/1999 Jaegers et al.
6,044,604 A 4/2000 Clayton et al.
AU 2000022066 2/2001
CA 1320130 8/1993
CA 2665652 10/2016
(Continued)

FOREIGN PATENT DOCUMENTS

AU 198813123 A 11/1988
AU 199888435 A 12/1998
(Continued)

*Primary Examiner* — Adriana Figueroa
(74) *Attorney, Agent, or Firm* — GREENBERG TRAURIG, LLP

(57) ABSTRACT

A roofing system and method of installing a roofing system can include a roof deck with first and second layers applied over the roof deck, and with a membrane applied thereover. The first and second layers can comprise insulation materials, with at least one of the first and second layers including a reinforced insulation material comprising a substrate with a reinforcing sublayer integrated therewith. The reinforcing sublayer can define an upper surface of the reinforced insulation material. The roofing system is configured to resist impacts from hail and other objects without a cover-board.

37 Claims, 10 Drawing Sheets

(56) References Cited

U.S. PATENT DOCUMENTS 6,092,344 A * 7/2000 Kelly ..... E04D 11/02 52/410
6,119,422 A 9/2000 Clear et al.
6,183,837 B1 2/2001 Kim
6,185,891 B1 2/2001 Moore
6,205,728 B1 3/2001 Sutelan
6,253,530 B1 7/2001 Price et al.
6,290,885 B1 9/2001 Roetheli et al.
6,341,462 B2 1/2002 Kiik et al.
6,355,701 B1 3/2002 Soukup et al.
6,569,509 B1 5/2003 Alts
6,586,080 B1 * 7/2003 Heifetz ..... B29C 66/72343 428/317.1
6,588,171 B2 7/2003 Pryor et al.
6,689,451 B1 2/2004 Peng et al.
6,890,023 B2 5/2005 Preisler et al.
6,983,571 B2 1/2006 Felton
7,493,733 B2 * 2/2009 Kelly ..... E04D 11/02 52/409
7,794,817 B2 9/2010 Brown
7,972,688 B2 * 7/2011 Letts ..... B32B 5/18 428/319.3
7,984,591 B2 7/2011 Cashin et al.
8,122,664 B2 * 2/2012 Ben-Daat ..... B32B 5/024 52/309.8
8,136,319 B2 3/2012 Kelly
8,158,450 B1 4/2012 Sheats et al.
8,215,083 B2 7/2012 Toas et al.
8,277,931 B1 10/2012 Kumar
8,323,770 B2 12/2012 Mehta et al.
8,590,267 B2 11/2013 Jaffee
8,617,699 B2 12/2013 Paradis et al.
9,217,249 B2 * 12/2015 Hong ..... E04D 5/10
9,334,379 B2 5/2016 Lindner et al.
9,540,811 B2 1/2017 Rapaz
9,611,647 B2 4/2017 Yang
9,636,892 B2 5/2017 Albert et al.
9,783,995 B2 10/2017 Meersseman et al.
9,845,600 B2 12/2017 Sypeck
10,087,634 B2 10/2018 Johnson et al.
10,151,104 B2 * 12/2018 Harrison ..... B32B 13/02
10,240,338 B2 3/2019 Durst et al.
10,259,199 B2 4/2019 Beuchel et al.
10,377,868 B2 8/2019 Kumar et al.
10,392,802 B2 8/2019 Kreizinger
10,415,245 B2 9/2019 Bennett et al.
10,577,499 B2 3/2020 Chen et al.
10,787,814 B2 9/2020 Duque et al.
10,960,643 B2 3/2021 Harrison et al.
10,961,709 B2 3/2021 Kreizinger
10,982,446 B2 4/2021 Swayne et al.
11,319,708 B2 5/2022 Leatherman et al.
11,407,209 B2 8/2022 Boss et al.
2003/0054127 A1 * 3/2003 Heifetz ..... E04B 1/665 428/40.1
2003/0082365 A1 5/2003 Geary et al.
2005/0126099 A1 6/2005 Kelly
2005/0170720 A1 8/2005 Christiansen et al.
2006/0096213 A1 5/2006 Griffin et al.
2006/0127664 A1 6/2006 Geary et al.
2006/0292945 A1 12/2006 Kuhn et al.
2007/0193167 A1 8/2007 Bruce et al.
2008/0029210 A1 2/2008 Swei et al.
2008/0161434 A1 7/2008 Paradis et al.
2008/0161436 A1 7/2008 Nandi
2008/0268225 A1 10/2008 Dehennau et al.
2009/0208714 A1 8/2009 Currier et al.
2011/0000159 A1 * 1/2011 Ben-Daat ..... B32B 5/022 156/324
2011/0065345 A1 3/2011 Phillips et al.
2011/0185651 A1 8/2011 Taylor
2011/0197543 A1 8/2011 Lee et al.
2012/0167509 A1 7/2012 Brandt et al.
2012/0266559 A1 10/2012 Thies, III
2013/0065020 A1 3/2013 Loftus et al.
2013/0072588 A1 3/2013 Rosthauser et al.
2013/0225020 A1 8/2013 Flood et al.
2015/0040503 A1 * 2/2015 Tackett ..... E04D 11/02 52/309.4
2015/0059277 A1 3/2015 Collins
2017/0268143 A1 9/2017 Paradis et al.
2018/0015688 A1 1/2018 Park et al.
2018/0037273 A1 2/2018 Aarts et al.
2018/0291163 A1 10/2018 Schneider et al.
2018/0319942 A1 11/2018 Kumar et al.
2018/0320370 A1 11/2018 Letts et al.
2018/0371758 A1 12/2018 Johnson et al.
2019/0194947 A1 6/2019 Brandt et al.
2020/0032043 A1 1/2020 Kaplan et al.
2020/0040582 A1 2/2020 Boss et al.
2020/0123776 A1 4/2020 Leatherman et al.
2020/0399901 A1 12/2020 Leatherman et al.
2021/0108408 A1 4/2021 Letts et al.
2021/0129484 A1 5/2021 Pacanovsky et al.
2022/0154453 A1 5/2022 Letts et al.
2022/0275646 A1 * 9/2022 Jiang ..... B32B 7/12
2023/0064072 A1 3/2023 Jones et al.
2023/0065390 A1 3/2023 Jones et al.

FOREIGN PATENT DOCUMENTS

CN 1183076 A 5/1998
CN 1265961 A 9/2000
CN 101270595 B 4/2010
CN 101942875 A 1/2011
CN 102191838 A 9/2011
CN 202846975 U 4/2013
CN 203270897 U 11/2013
CN 207579234 U 7/2018
CN 108396900 A 8/2018
CN 208918101 U 5/2019
CN 209211615 U 8/2019
CN 111267455 A 6/2020
DE 2458260 A1 6/1976
EP 420242 B1 12/1995
EP 0573366 B1 1/1996
EP 1253260 A3 10/2003
EP 940249 B1 11/2008
EP 3483353 A1 5/2019
FR 2554484 A1 5/1985
FR 2691995 A1 12/1993
GB 2148346 A 5/1985
GB 2341619 A 3/2000
GB 2347440 A 9/2000
JP 63290726 A 11/1988
JP 7329197 A 12/1995
JP 8238699 A 9/1996
JP 10060239 A 3/1998
JP 10175273 A 6/1998
JP 11279366 A 10/1999
JP 2001172844 A 6/2001
JP 2002284823 A 10/2002
JP 2003040138 A 2/2003
JP 05049269 B2 10/2012
NL 1004727 C1 4/1997
WO WO 94/17995 A1 8/1994
WO WO 95/00756 A1 1/1995
WO WO 96/30202 A1 10/1996
WO WO2000/030845 A1 6/2000
WO WO00/39418 A1 7/2000
WO WO2003/031748 A3 12/2003
WO WO2011/045778 A1 4/2011
WO WO2013/190474 A1 12/2013
WO WO2014/116791 A1 7/2014
WO WO2017/180154 A1 10/2017
WO WO2018/023147 A1 2/2018
WO WO2021/032805 A1 2/2021
WO WO2021/067469 A1 4/2021
WO WO2022/271620 A1 12/2022
WO WO2023/014771 A1 2/2023

* cited by examiner

ROOFING SYSTEM

CROSS-REFERENCE

The present application claims the benefit of U.S. Provisional Application No. 63/468,299, filed May 23, 2023.

INCORPORATED BY REFERENCE

The disclosure made in U.S. Provisional Application No. 63/468,299 filed May 23, 2023 is specifically incorporated by reference as if set forth in its entirety.

TECHNICAL FIELD

The present disclosure relates generally to roofing systems and more particularly to roofing systems incorporating a reinforced insulation material configured to provide increased structural, thermal and moisture performance.

BACKGROUND

Impacts from hail and other debris against a roof can cause significant damage to a roof. Insurers have created specific testing requirements for certifications for hail resistant roofing systems. In particular, for the "Very Severe Hail" (VSH) classification, requirements include the ability to withstand 2-inch ice balls propelled at 152-160 feet per second, resulting in an impact energy of 53-58 ft-lbs. It can be seen that needs exist for roofing systems that can provide resistance to impacts from very severe hail and/or other types or levels of impact resistance such as in accordance with such requirements. The present disclosure addresses these and other related and unrelated issues.

SUMMARY

Briefly described, the present disclosure is directed to roofing systems and components thereof, and to methods of forming and installing such roofing systems and components thereof.

According to aspects of the present disclosure, roofing systems and components thereof are provided, which are configured to withstand impacts from objects such as very severe hail striking the roofing systems. In embodiments, the roofing systems can include one or more layers of insulation materials, with at least one of the layers of insulation including a reinforced insulation material, positioned along a roofing substrate or roof deck, and further can include a membrane positioned over the one or more layers of insulation material, but which roofing systems do not include the use of or need for a coverboard as part of the roofing system. For example, coverboards that generally are required for the protection of roofing systems from impacts such as hail (which can include boards constructed of materials such as gypsum, wood fiber, cement, perlite, asphaltic materials, mineral fibers, plywood, or oriented strand boards) are not required for protection of the roofing systems of the present disclosure.

In some embodiments, roofing systems are provided, which can include roofing materials such as a roof deck, a first layer of an insulation material positioned along the roof deck, and a second layer of an impact resistant reinforced insulation material positioned along an upper surface of the first layer. In embodiments, the reinforced insulation material can include a fiber reinforced polymer composite material integrated with substrate that comprises an insulation material (e.g., a polyisocyanurate insulation or other insulation material) configured to form a fiber reinforced polymer composite insulation material with integrated protection against impacts such that a layer of coverboards, e.g., separate protective coverboard sheets or panels positioned over the first and second layers of insulation materials, are not required to provide the roofing systems with resistance to impacts from hail or other objects striking the roofing system.

In addition, in embodiments, a membrane can be applied over an upper surface of the second layer to provide further protections to the roofing system. For example, and without limitation, the membrane can comprise a material configured to provide resistance to weather, including water shedding (e.g., facilitating flowing of water away from the roofing system); water resistance (e.g., resistance to the passage of water flow therethrough); water ponding (e.g., unwanted pooling or collection of water); ultra violet light (UV) resistance, and other selected properties. In embodiments, the membrane can comprise a membrane such as a thermoplastic polyolefin (TPO), an ethylene propylene diene monomer (EPDM), polyvinyl chloride (PVC), or a modified bitumen membrane. In embodiments, the membrane can be applied to the upper surface of the second layer in the field; such as in sheets, or by being rolled out over the upper surface of the second layer. In other embodiments, the membrane can be pre-applied to the upper surface of the reinforced insulation material of the second layer as part of the manufacturing process thereof. In embodiments, the membrane can be adhered to the fiber reinforced composite polymer material of the reinforced insulation material with an adhesive, or can be heat welded thereto.

In some embodiments, a roofing system according to the principles of the present disclosure can include a first layer that can comprise a first insulation material, such as, for example, a polyisocyanurate insulation material, or other insulation material positioned on top of the roof deck. In embodiments, the roofing systems further can include a second layer, which, in embodiments, can include a reinforced insulation material layer. As an example, in some embodiments, the second layer can include a fiber reinforced polymer composite insulation material layer comprising a substrate having a reinforcing sublayer integrated therewith (for example, in embodiments, a glass fiber reinforced polymer composite material layer), wherein the reinforcing sublayer can define an upper surface of the second layer. In embodiments, the substrate can comprise a second insulation material that, in embodiments, can include a polyisocyanurate insulation material or other insulation material. In embodiments, the reinforcing sublayer can comprise a fiber reinforced composite polymer material formed as a facer or skin applied to an upper surface of the substrate.

In addition, in embodiments, the first insulation material of the first layer can be formed with an increased thickness. For example, in embodiments, the first layer can comprise a first insulation material having a thickness of approximately 1 inch to approximately 3.6 inches, which can help provide enhanced insulation properties for the roofing system. In some embodiments, the roofing system can include a third layer of insulation material that can be positioned along an upper surface of the first layer or arranged between the first and second layers of insulation material. In embodiments, the roofing system can include a plurality of sections, with the third layer being configured to increase the thickness of the first insulation material to help increase the insulation properties of the roofing system.

In embodiments, the roofing system further includes a membrane attached to the reinforcing sublayer of the second layer. In embodiments, the membrane can be configured to provide weather resistance and various other properties to the roofing system, for example and without limitation, water shedding (e.g., facilitating flowing of water away from the roofing system); water resistance (e.g., resistance to the passage of water flow therethrough); water ponding (e.g., unwanted pooling or collection of water); ultra violet light (UV) resistance, and other selected properties.

In some embodiments, the membrane can be attached to the reinforced insulation material, such by an adhesive, by heat welding, or otherwise being bonded to the fiber reinforced polymer composite material to provide weather resistance properties. In some embodiments, the membrane can be applied over the reinforced insulation material in the field a part of a method of forming a roof; while in other embodiments, the membrane can be attached to the reinforced insulation panels as part of the manufacture thereof, such that the reinforced insulation panels can be formed with integrated impact protection functionality to resist cracking and provide protection against impacts, and with a weather resistant upper surface to facilitate installation of the roofing system without requiring a coverboard as is required in conventional roof structures.

In embodiments, a roofing system formed or installed according to the principles of the present disclosure can include a roof deck, first and second layers of insulation material applied over the roof deck, and a membrane positioned over the upper surface of the second later of insulation, wherein the roofing system is configured to meet or exceed requirements for Very Severe Hail Resistance according to ANSI FM 4473 VSH Impact Resistance Testing Standard for Impact Resistance Testing of Rigid Roofing Materials by Impacting with Freezer Ice Balls (FM 4473). In addition, in embodiments, other test methods can be used, such as, for example, FM 4470 VSH Impact Resistance Testing Standard for Single-Ply, Polymer-Modified Bitumen Sheet, Built-Up Roof (BUR) and Liquid Applied Roof Assemblies (FM 4470). The disclosed roofing systems can meet or exceed these requirements without requiring the inclusion of a coverboard for protection against impacts from hail, including very severe hail. In addition, in embodiments, the roofing system can be configured to provide a resistance to conductive heat flow through the roofing system having an R-value of at least R30, such that the roofing system has an overall resistance to conductive heat flow that is substantially equal to or greater than an overall resistance to conductive heat flow through a conventional roofing system including a coverboard, without a substantial difference in thickness of the roofing system versus such a roofing system including a coverboard.

Various aspects of roofing systems and components of roofing systems can include, in embodiments, a plurality of layers of insulation materials secured along a roof deck, at least one of the layers of insulation materials including a reinforced insulation material comprising an insulation material having a reinforcing sublayer that comprises a fiber reinforced polymer composite material integrated therewith.

According to one aspect, a roofing system is provided, the roofing system comprising a roof deck; a first layer positioned above the roof deck, the first layer comprising a first insulation material; a second layer positioned above the first layer, the second layer comprising a substrate comprising a second insulation material; and a reinforcing sublayer laminated to, attached to, extruded with, or molded with the substrate so as to be integrated with the substrate, the reinforcing sublayer comprising a fiber reinforced polymer composite material and defining an upper surface of the second layer opposite the first layer; and a membrane positioned above the upper surface of the second layer; wherein the roofing system does not include a coverboard between the roof deck and the membrane.

In embodiments, the roofing system further comprises an adhesive material applied between the membrane and the upper surface of the second layer and configured to attach the membrane to the fiber reinforced polymer composite material of the second layer.

In some embodiments, second layer further comprises an adhesive material applied between the substrate and the fiber reinforced polymer composite material of the reinforcing sublayer. In embodiments, the adhesive material comprises isocyanate terminated urethane polymers, methacrylate's, butyl-based adhesives, polymer modified asphaltic materials, polyurethane foams, rubber contact adhesives, or combinations thereof.

In embodiments of the roofing system, the second layer is configured to provide a resistance cracking upon impact of an object thereagainst such that the roofing system exceeds requirements for Very Severe Hail Resistance according to FM 4473 VSH Impact Resistance Testing Standard for Impact Resistance Testing of Rigid Roofing Materials by Impacting with Freezer Ice Balls.

In embodiments of the roofing system, the fiber reinforced polymer composite material comprises a plurality of glass fibers, fiberglass fibers, carbon fibers, natural fibers, or a combination thereof, and a resin.

In embodiments of the roofing system. the resin comprises a polymer, a biodegradable material, low-carbon footprint material, or a combination thereof.

In embodiments of the roofing system, the fiber reinforced polymer composite material comprises a thickness of 1 mm to 8 mm.

In embodiments of the roofing system, the fiber reinforced polymer composite material comprises a sheet formed by molding a plurality of fibers with a sheet molding compound.

In embodiments of the roofing system, the fiber reinforced polymer composite material comprises a sheet formed by a pultrusion process and including a resin and a plurality of substantially continuous fibers.

In embodiments the roofing system further comprise a layer of a vapor retardant material positioned between the roof deck and the first insulation layer.

In embodiments of the roofing system, the membrane comprises a two-ply modified bitumen material including a base sheet comprising a bituminous asphalt material and a cap sheet comprising a polymeric material applied over the base sheet.

In embodiments of the roofing system, the membrane comprises at least one of a thermoplastic polyolefin, an ethylene propylene diene monomer, polyvinyl chloride, or a modified bitumen material.

In embodiments of the roofing system, the first insulation material and the second insulation material each comprise polyisocyanurate, mineral wool, expanded polystyrene foam, extruded polystyrene foam, or a combination thereof.

In embodiments of the roofing system, the first insulation layer and the second insulation layer each comprise a thickness of 2 inches to 3.6 inches.

In embodiments, the roofing system further comprises a third insulation layer attached to the first insulation layer, the third insulation layer having a thickness of less than 2 inches.

In embodiments of the roofing system, the first layer comprises a thickness of 1 inch to 3.65 inches; and the second layer comprises a thickness of 1 inch to 3.75 inches.

In embodiments of the roofing system, the first insulation layer and the second insulation layer together are configured to provide a resistance to conductive heat flow through the roofing system having an R-value of at least R30; and further comprising a third insulation layer comprising an additional insulation material positioned along the first insulation layer; wherein the third insulation layer is configured to increase the resistance to conductive heat flow of the roofing system such that the roofing system has an overall resistance to conductive heat flow that is equal to or greater than an overall resistance to conductive heat flow of a roofing system including a coverboard.

In embodiments, the roofing system further comprises an additional reinforcing sublayer attached to a lower surface of the substrate; wherein the additional reinforcing sublayer comprises a fiber reinforced material that is different from the fiber reinforced polymer composite material positioned along the upper surface of the substrate.

In embodiments of the roofing system, the first insulation layer has a first thickness, and the second insulation layer has a second thickness that is greater than the first thickness of the first insulation layer; and wherein the roofing system has a thickness substantially equal to or less than a thickness of a roofing system including a coverboard.

In embodiments, the roofing system further comprises at least one sensor coupled to the second insulation layer.

In embodiments of the roofing system, the membrane comprises a polymeric sheet configured to resist migration of water therethrough.

According to another aspect, a package is provided, the package comprising a plurality of reinforced insulation panels; wherein each of the reinforced insulation panels comprises a substrate; and a reinforcing sublayer laminated to, attached to, extruded with or molded with the substrate so as to be integrated with the substrate, the reinforcing sublayer comprising a fiber reinforced polymer composite material and defining an upper surface of each reinforced insulation panel; wherein the reinforced insulation panels are configured to provide a resistance to cracking upon impact of an object thereagainst such that when the reinforced insulation panels are included as part of a roofing system having a first layer of insulation panels positioned along a roof deck, a second layer of the reinforced insulation panels above the first layer of insulation panels, a membrane on top of the upper surfaces of the reinforced insulation panels, and without a coverboard positioned between the membrane and the insulation panels, the roofing system exceeds requirements for Very Severe Hail Resistance according to FM 4473 VSH Impact Resistance Testing Standard for Impact Resistance Testing of Rigid Roofing Materials by Impacting with Freezer Ice Balls.

In embodiments of the package, the reinforced insulation panels further comprise an additional reinforcing sublayer attached to a lower surface of the substrate; wherein the additional reinforcing sublayer comprises a fiber reinforced material that is different from the fiber reinforced polymer composite material positioned along the upper surface of the substrate.

In embodiments of the package, the reinforced insulation panels each further comprise a membrane attached to an upper surface thereof; wherein the membrane comprises a two-ply modified bitumen material including base sheet attached to the fiber reinforced polymer composite material and comprising a bituminous asphalt material, and a cap sheet applied over the base sheet and comprising a weather resistant polymeric material.

In embodiments of the package, the reinforced insulation panels each comprise a thickness of 2 inches to 3.75 inches.

In embodiments of the package, the substrate comprises polyisocyanurate, mineral wool, expanded polystyrene foam, extruded polystyrene foam, or a combination thereof.

In embodiments of the package, the fiber reinforced polymer composite material comprises a plurality of glass fibers, fiberglass fibers, carbon fibers, natural fibers, or a combination thereof, and a resin molded or extruded to form the fiber reinforced material.

In embodiments of the package, the resin comprises a polymer, a biodegradable material, low-carbon footprint material, or a combination thereof.

In embodiments of the package, the fiber reinforced polymer composite material comprises a thickness of 1 mm to 8 mm.

In embodiments, the package further comprises a plurality of insulation panels comprising a first insulation material and configured without a fiber reinforcing polymer composite material positioned along an upper surface thereof.

In some embodiments, the first insulation material comprises polyisocyanurate, mineral wool, expanded polystyrene foam, extruded polystyrene foam, or a combination thereof.

In embodiments of the package, the insulation panels and the reinforced insulation panels together are configured to provide a resistance to conductive heat flow through the roofing system having an R value of at least R30.

According to another aspect, a method of forming a roofing system comprises positioning a first layer along a roof deck; wherein the first layer comprises a first insulation material and has a lower surface facing the roof deck and an upper surface; positioning a second layer over the upper surface of the first insulation layer; wherein the second layer comprises a second insulation material including a substrate; and a reinforcing sublayer laminated to, attached to, extruded with or molded with the substrate so as to be integrated with the substrate, the reinforcing sublayer comprising a fiber reinforced polymer composite material and defining an upper surface of the second layer opposite the first layer; positioning a membrane over the second insulation layer; wherein the roofing system does not include a coverboard between the roof deck and the membrane.

In embodiments, the method further comprises positioning a layer of a vapor retardant material along the roof deck prior to positioning the first insulation layer on the roof deck.

In embodiments, the method further comprises applying an adhesive between the fiber reinforced polymer composite material of the second insulation layer and the membrane; wherein the adhesive is configured to attach the membrane to the fiber reinforced polymer composite material.

In some embodiments, the adhesive material can include isocyanate terminated urethane polymers, methacrylate's, butyl-based adhesives, polymer modified asphaltic materials, polyurethane foams, rubber contact adhesives, or combinations thereof.

In some embodiments, the method further comprises applying heat to the membrane after positioning the membrane over the second insulation layer to attach the membrane to the second insulation layer.

In embodiments, the method further comprises positioning a third layer along an upper surface of the roof deck, and attaching the lower surface of the first layer to the upper surface of the third layer; wherein the third layer comprises an insulation material.

In embodiments of the method, the first layer and the second layer together are configured to provide a resistance to conductive heat flow through the roofing system having an R value of at least R30.

According to still another aspect, a roofing system comprises a roof deck; at least two first insulation panels positioned above the roof deck, each of the first insulation panels comprising a first insulation material; at least two second insulation panels positioned above the first insulation panels, each of the second insulation panels comprising a second insulation material; wherein the second insulation material comprises a substrate, and a reinforcing sublayer laminated to, attached to, extruded with or molded with the substrate so as to be integrated with the substrate, the reinforcing sublayer comprising a fiber reinforced polymer composite material and defining an upper surface of the each of the second insulation panels; and a membrane positioned above the second insulation panels; wherein the roofing system does not include a coverboard between the roof deck and the membrane.

In embodiments of the roofing system, the second insulation panels are configured to provide a resistance to cracking upon impact of an object thereagainst such that the roofing system exceeds requirements for Very Severe Hail Resistance according to FM 4473.

In embodiments, the roofing system further comprises a layer of a vapor retardant material positioned between the roof deck and the first insulation panels.

In embodiments, the roofing system further comprises an adhesive material applied to the upper surfaces of the second insulation panels and configured to attach the membrane to the upper surfaces of the second insulation panels.

In some embodiments, second insulation material further comprises an adhesive material attaching the substrate to the fiber reinforced polymer composite material; wherein, in embodiments, the adhesive material comprises isocyanate terminated urethane polymers, methacrylate's, butyl-based adhesives, polymer modified asphaltic materials, polyurethane foams, rubber contact adhesives, or combinations thereof.

In embodiments, the roofing system further comprises an additional reinforcing sublayer attached to a lower surface of the substrate; wherein the additional reinforcing sublayer comprises a fiber reinforced material that is different from the fiber reinforced polymer composite material positioned along the upper surface of the substrate.

In embodiments of the roofing system, the substrate of the second insulation material comprises polyisocyanurate, mineral wool, expanded polystyrene foam, extruded polystyrene foam, or a combination thereof.

According to a further aspect, a package is provided, the package comprising a plurality of insulation panels including reinforced insulation panels each comprising a substrate comprising an insulation material, and a reinforcing sublayer laminated to, attached to, extruded with or molded with the substrate so as to be integrated with the substrate; wherein the reinforcing sublayer comprises a fiber reinforced polymer composite material; and a membrane comprising at least one of a thermoplastic polyolefin, an ethylene propylene diene monomer, polyvinyl chloride, or a modified bitumen sheet including a base sheet comprising a bituminous asphalt material and a cap sheet comprising polymeric materials or a combination thereof; wherein the reinforced insulation panels are configured to provide a resistance to cracking upon impact of an object thereagainst such that when the reinforced insulation panels are included as part of a roofing system without a coverboard, the roofing system exceeds requirements for Very Severe Hail Resistance according to FM 4473 VSH Impact Resistance Testing Standard for Impact Resistance Testing of Rigid Roofing Materials by Impacting with Freezer Ice Balls.

In embodiments, the reinforced insulation panels further comprise an additional reinforcing sublayer attached to a lower surface of the substrate; wherein the additional reinforcing sublayer comprises a fiber reinforced material that is different from the fiber reinforced polymer composite material positioned along an upper surface of the substrate.

In embodiments, the reinforced insulation panels each further comprise a membrane attached to an upper surface thereof; wherein the membrane comprises a two-ply modified bitumen material including base sheet attached to the fiber reinforced polymer composite material and comprising a bituminous asphalt material, and a cap sheet applied over the base sheet and comprising a weather resistant polymeric material.

In some embodiments, the reinforced insulation panels each comprise a thickness of 2 inches to 3.75 inches.

In some embodiments, the substrate comprises polyisocyanurate, mineral wool, expanded polystyrene foam, extruded polystyrene foam, or a combination thereof.

In some embodiments, the fiber reinforced polymer composite material comprises a plurality of glass fibers, fiberglass fibers, carbon fibers, natural fibers, or a combination thereof, and a resin molded or extruded to form the fiber reinforced material.

In embodiments, the resin comprises a polymer, a biodegradable material, low-carbon footprint material, or a combination thereof.

In embodiments, the fiber reinforced polymer composite material comprises a thickness of 1 mm to 8 mm.

In embodiments, the package further comprises a plurality of insulation panels comprising an insulation material including polyisocyanurate, mineral wool, expanded polystyrene foam, extruded polystyrene foam, or a combination thereof and configured without a fiber reinforcing polymer composite material positioned along an upper surface thereof.

In embodiments of the package, the insulation panels and the reinforced insulation panels together are configured to provide a resistance to conductive heat flow through the roofing system having an R value of at least R30.

In some embodiments, the package further comprises an adhesive material adapted to attach the membrane to the fiber reinforced polymer composite material of the reinforced insulation panels.

According to another aspect, a method is provided, the method comprising mixing a plurality of reinforcing fibers with a resin or sheet molding compound to form a mixture; wherein the reinforcing fibers include glass fibers, fiberglass fibers, carbon fibers, natural fibers or combinations thereof; forming the mixture into a fiber reinforced polymer composite sheet; moving the fiber reinforced polymer composite sheet along a path of travel; and attaching an insulation material to a first surface of the fiber reinforced polymer composite sheet such that the fiber reinforced polymer composite sheet is integrated with the insulation material to form a fiber reinforced polymer composite insulation material; wherein the fiber reinforced polymer composite insulation material is configured to provide a resistance to cracking upon impact of an object thereagainst such that when the fiber reinforced polymer composite insulation material is included as part of a roofing system with a first layer of an insulation material and a membrane, and without a coverboard, the roofing system exceeds requirements for Very Severe Hail Resistance according to FM 4473 VSH Impact Resistance Testing Standard for Impact Resistance Testing of Rigid Roofing Materials by Impacting with Freezer Ice Balls.

In embodiments, the method further comprises applying a modified bitumen sheet to a second side of the fiber reinforced polymer composite sheet.

In embodiments, attaching an insulation material to the first surface of the fiber reinforced polymer composite sheet comprises depositing a foam mixture including polyisocyanurate and at least one isocyanate reactive compound along the first surface of the fiber reinforced polymer composite sheet, and allowing the foam mixture to expand to form a polyisocyanurate foam; wherein upon expanding, the polyisocyanurate foam is substantially integrated with the fiber reinforced polymer composite sheet.

In embodiments, attaching an insulation material to a first surface of the fiber reinforced polymer composite sheet comprises applying an adhesive material between the insulation material and the fiber reinforced polymer composite sheet, and adhesively attaching the insulation material to the fiber reinforced polymer composite sheet.

In embodiments, forming the mixture into the fiber reinforced polymer composite sheet comprises mixing a plurality of short reinforcing fibers with a sheet molding compound, and pressing the mixture.

In embodiments, forming the mixture into the fiber reinforced polymer composite sheet comprises mixing a continuous stream of reinforcing fibers with a resin.

In embodiments, the method further comprises applying a facer to the insulation material along one side thereof opposite the fiber reinforced polymer composite sheet.

According to another embodiments, a method of forming a roof comprises: positioning a first layer along a roof deck, the first layer including a first insulation material having a lower surface and an upper surface; positioning a second layer over the upper surface of the first insulation layer; wherein the second layer comprises a second insulation material including a substrate, and a reinforcing sublayer laminated to, attached to, extruded with, or molded with the substrate so as to be integrated with the substrate; wherein the reinforcing sublayer comprises a fiber reinforced polymer composite material and defines an upper surface of the second insulation material; applying a membrane over the reinforcing sublayer of the second insulation material; and wherein the second insulation material is configured to provide a resistance cracking upon impact of an object thereagainst such that the roof exceeds requirements for Very Severe Hail Resistance according to FM 4473 VSH Impact Resistance Testing Standard for Impact Resistance Testing of Rigid Roofing Materials by Impacting with Freezer Ice Balls.

In embodiments, the method further comprises positioning a layer of a vapor retardant material along the roof deck prior to positioning the first insulation layer on the roof deck.

In embodiments, the method further comprises applying an adhesive between the reinforcing sublayer of the second insulation layer and the membrane; wherein the adhesive is configured to attach the membrane to the fiber reinforced polymer composite material of the reinforcing sublayer.

In some embodiments, the adhesive material comprises an isocyanate terminated urethane polymers, methacrylate's, butyl-based adhesives, polymer modified asphaltic materials, polyurethane foams, rubber contact adhesives, or combinations thereof.

In some embodiments, the method further comprises applying heat to the membrane after positioning the membrane over the second insulation layer to attach the membrane to the second insulation layer.

In embodiments, the method further comprises applying a third layer comprising an insulation to the first layer.

In embodiments of the method, the first insulation material of the first layer and the second insulation material of the second layer are configured to provide a resistance to conductive heat flow through the roof having an R value of at least R30.

In embodiments of the method, the membrane comprises a modified bitumen sheet; and wherein applying a membrane over the reinforcing sublayer of the second insulation material comprises applying an adhesive between the modified bitumen sheet and the reinforcing sublayer; wherein the adhesive is configured to adhere the reinforcing sublayer of the second insulation material to the modified bitumen sheet.

According to a further aspect, a method comprises forming a mixture of reinforcing fibers and a resin or sheet molding compound, wherein the reinforcing fibers include glass fibers, fiberglass fibers, carbon fibers, natural fibers or combinations thereof; applying the mixture to a first surface of an insulation material to form a fiber reinforced polymer composite insulation panel or sheet comprising a fiber reinforced polymer composite sheet formed from the mixture of the reinforcing fibers and the resin or sheet molding compound integrated with the insulation material; wherein the fiber reinforced polymer composite insulation material is configured to provide a resistance to cracking upon impact of an object thereagainst such that when the fiber reinforced polymer composite insulation material is included as part of a roofing system the roofing system exceeds requirements for Very Severe Hail Resistance according to FM 4473 VSH Impact Resistance Testing Standard for Impact Resistance Testing of Rigid Roofing Materials by Impacting with Freezer Ice Balls.

In embodiments, the method further comprises applying a modified bitumen sheet to a second side of the fiber reinforced polymer composite sheet.

In embodiments of the method, attaching an insulation material to the first surface of the fiber reinforced polymer composite sheet comprises depositing a foam mixture including polyisocyanurate and at least one isocyanate reactive compound along the first surface of the fiber reinforced polymer composite sheet, and allowing the foam mixture to expand to form a polyisocyanurate foam; wherein upon expanding, the polyisocyanurate foam is substantially integrated with the fiber reinforced polymer composite sheet.

In embodiments of the method, attaching an insulation material to a first surface of the fiber reinforced polymer composite sheet comprises applying an adhesive material between the insulation material and the fiber reinforced polymer composite sheet, and attaching the insulation material to the fiber reinforced polymer composite sheet.

In some embodiments, applying the adhesive material can comprise spraying, rolling, extruding, mopping, or combinations thereof, the adhesive material along the first surface of the fiber reinforce composite sheet or along an upper surface of the insulation material.

In embodiments, the adhesive material can include isocyanate terminated urethane polymers, methacrylate's, butyl-based adhesives, polymer modified asphaltic materials, polyurethane foams, rubber contact adhesives, or combinations thereof.

In embodiments of the method, forming the mixture into the fiber reinforced polymer composite sheet comprises mixing a plurality of short reinforcing fibers with a sheet molding compound, and pressing the mixture.

In embodiments of the method, forming the mixture into the fiber reinforced polymer composite sheet comprises mixing a continuous stream of reinforcing fibers with a resin.

In embodiments, the method further comprises applying a facer to the insulation material along one side thereof opposite the fiber reinforced polymer composite sheet.

Accordingly, embodiments of roofing systems, reinforced insulation materials for use in such roofing systems, and methods for forming reinforce insulation materials, and for installing such reinforced insulation materials to a roofing system with enhanced resistance to impacts without including a coverboard as part of the roofing system, which are directed to the above discussed and other needs are disclosed. The foregoing and other advantages and aspects of the embodiments of the present disclosure will become apparent and more readily appreciated from the following detailed description, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Figure 1A:
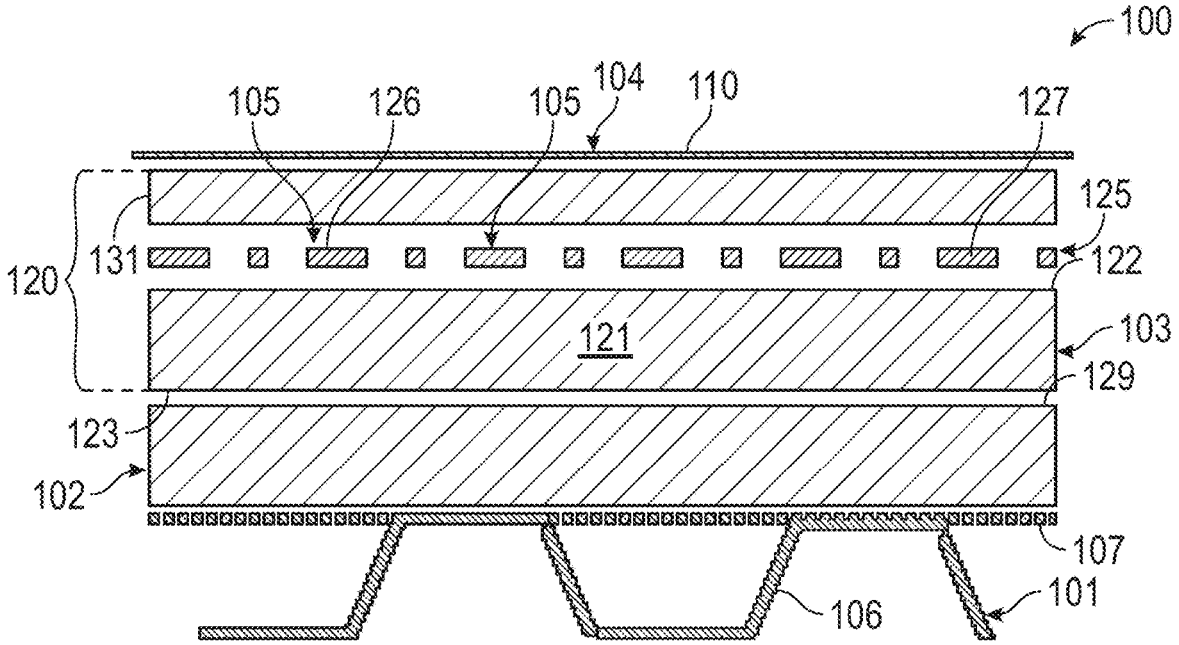
FIG. 1A is an end view of an example embodiment of a roofing system including a reinforced insulation material layer without a coverboard according to the principles of the present disclosure.

Embodiments of the present disclosure will now be described in more detail with reference to the attached drawing figures.

The present disclosure is directed to roofing systems, methods of installing roofing systems, and to reinforced insulation panels for use in roofing systems as described herein and illustrated in FIGS. 1A-9. In embodiments, the reinforced insulation panels are configured to withstand damage from impacts by hail or other objects thereagainst to protect the roofing systems from exposure to impacts such as from hail, and in particular, very severe hail, without the inclusion of a coverboard in the roofing systems.

For a roofing system to achieve certification or classification as a hail resistant roofing system, including to be achieve a "Very Severe Hail" (VSH) certification or classification (Class 4—the most stringent certification), the roofing system and components thereof generally must meet the requirements provided under Factory Mutual (FM)® hail-resistant test method ANSI FM 4473 "Specification test standard for Impact Resistance Testing of Rigid Roofing Materials by Impacting with Freezer Ice Balls" (FM 4473). The FM 4473 testing standard for Very Severe Hail Resistance requires the roofing system withstand up to 2-inch ice balls propelled at 152-160 feet per second, resulting in an impact energy of 53-58 ft. lbs. Withstanding such testing may mean, after impact, the roofing system components will not exhibit cracks, dents, and/or other visible damage.

In addition, in embodiments, other standards and tests may be utilized to classify hail resistant roofing systems and/or components of such roofing systems, such as ASTM D3746 and/or UL 2218. For example, in some embodiments, other testing methods and standards, such as ANSI FM 4470 directed to testing of hail resistance for "Single-Ply, Polymer-Modified Bitumen Sheet, Built-Up Roof (BUR) and Liquid Applied Roof Assemblies for use in Class 1 and Noncombustible Roof Deck Construction" (FM 4470) can be used.

The roofing systems 100 (FIGS. 1A-1B) illustrated by the example embodiments of the present disclosure are configured to meet or exceed the FM 4473 testing Standard for Very Severe Hail certification without requiring the use of a coverboard. As used herein, the term "coverboard" refers to a rigid substrate or board positioned between the upper layer of insulation and a covering membrane applied over the coverboard, and which can be formed from materials such gypsum, including gypsum boards or fiber reinforced gypsum boards, which further can include fiberglass facer, boards made from wood fiber, perlite, mineral fibers, plywood or oriented strand board (OSB), cement and/or other rigid, high density materials. Such coverboards typically range in thickness from about 2 inches to 0.5 inches, and are added to a conventional roofing system to provide strength and rigidity for protection of the roofing system from hail and other objects striking the roof structure. Such coverboards can be expensive and time consuming to install, adding to the complexity and cost of a roofing system.

In embodiments, roofing systems formed according to the principles of the present disclosure can be used for commercial and residential construction. For example, in embodiments, the roofing systems can be configured to form a low slope roof, including a roof having a slope or pitch of Y/X, where Y corresponds to the "rise" of the roof, and where X corresponds to the "run" of the roof. In embodiments, the roof can have a pitch or slope where Y and X are in a ratio of less 4:12. In some embodiments, Y and X are in a ratio of less than 3:12. In some embodiments, Y and X are in a ratio of less than 2:12. In some embodiments, Y and X are in a ratio of less than 1:12. In some embodiments, Y and X are in a ratio of 1:12 to 3:12.

In other embodiments, the roofing system can be configured to form a roof having a slope of greater than a ratio of 4:12. For example, the roof can have a pitch or slope where Y and X are in a ratio of 4:12 to 12:12. In some embodiments, Y and X are in a ratio of 5:12 to 12:12. In some embodiments, Y and X are in a ratio of 6:12 to 12:12. In some embodiments, Y and X are in a ratio of 7:12 to 12:12. In some embodiments, Y and X are in a ratio of 8:12 to 12:12. In some embodiments, Y and X are in a ratio of 9:12 to 12:12. In some embodiments, Y and X are in a ratio of 10:12 to 12:12. In some embodiments, Y and X are in a ratio of 11:12 to 12:12.

Figure 1B:
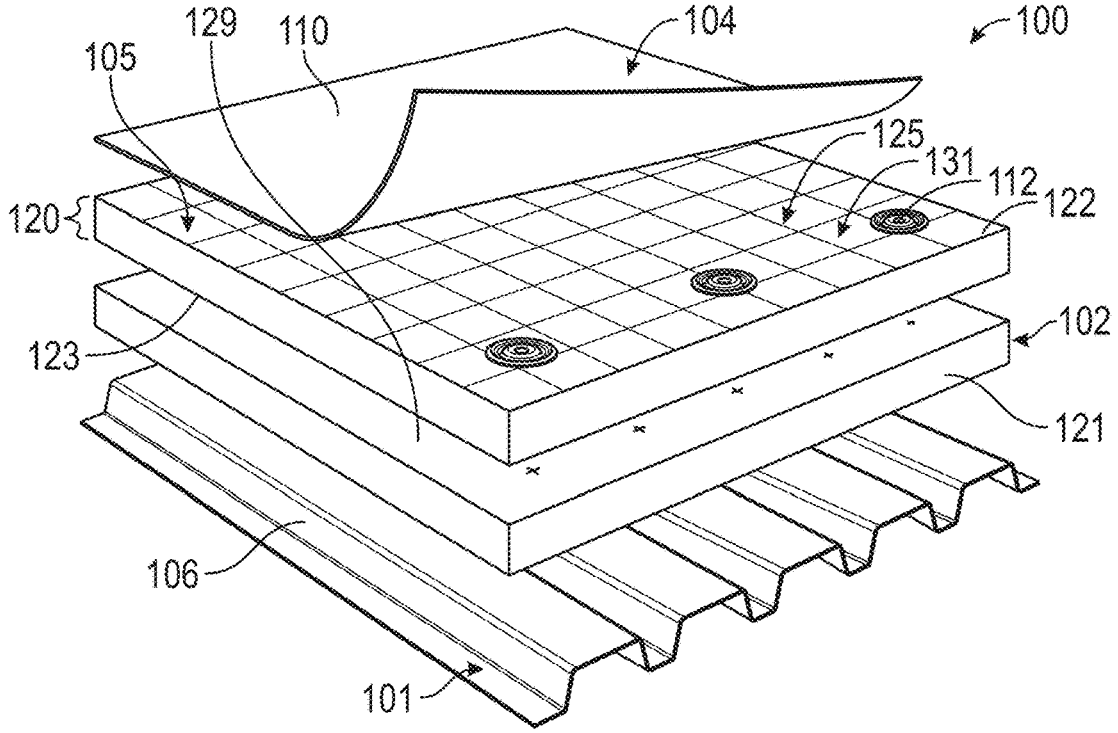
FIG. 1B is a perspective view of example embodiment of a roofing system including a reinforced insulation material layer without a coverboard according to the principles of the present disclosure.
Figure 2A:
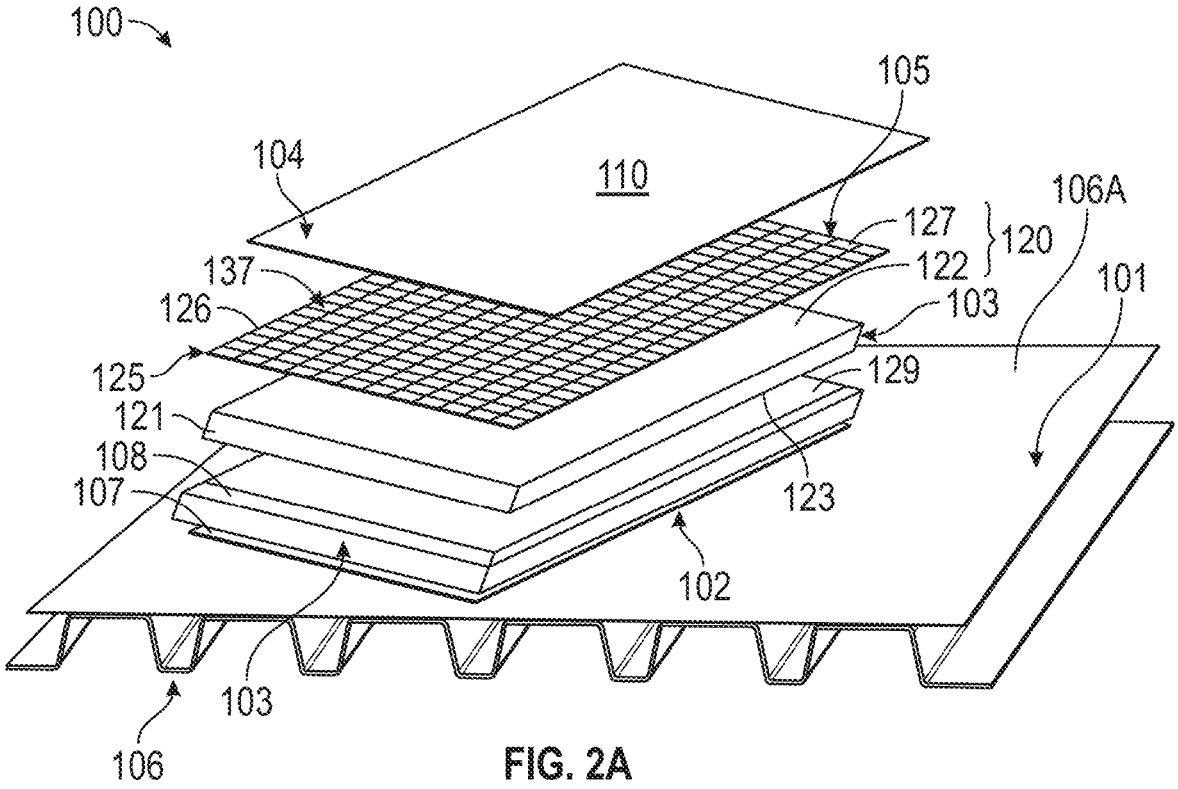
FIG. 2A and FIG. 2B show additional embodiments of roofing systems according to the principles of the present disclosure.
Figure 2B:
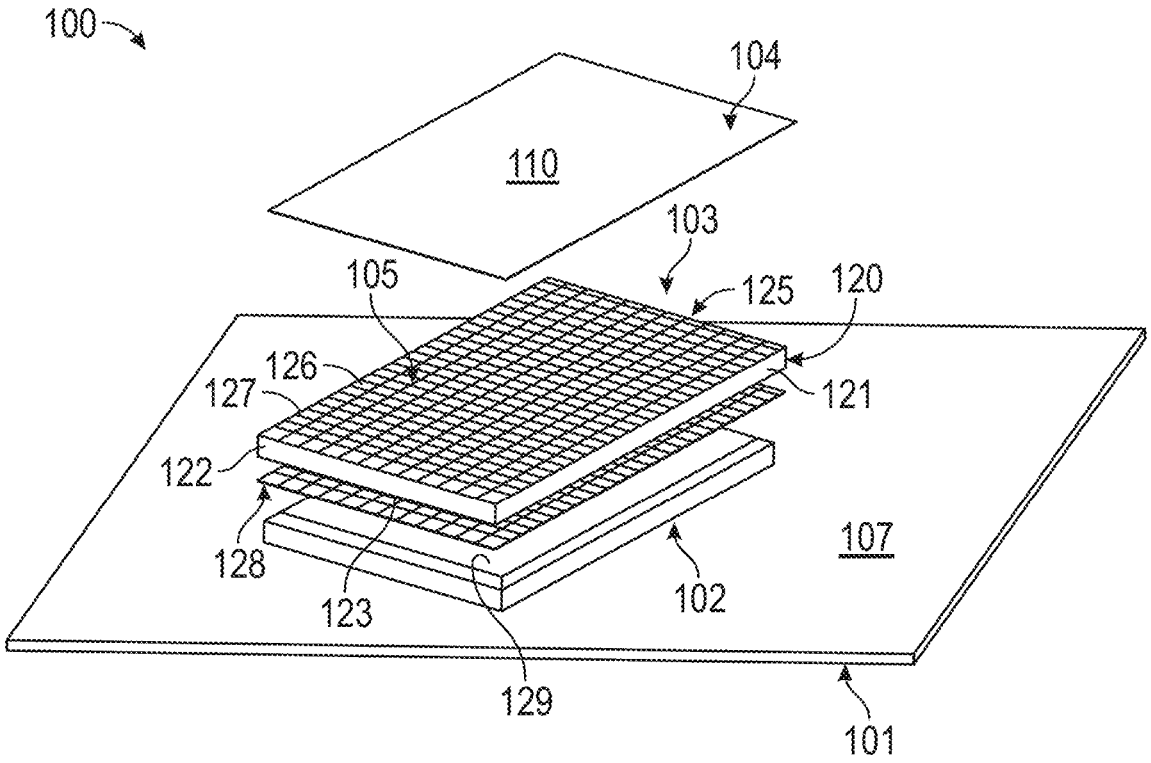
Figure 6:
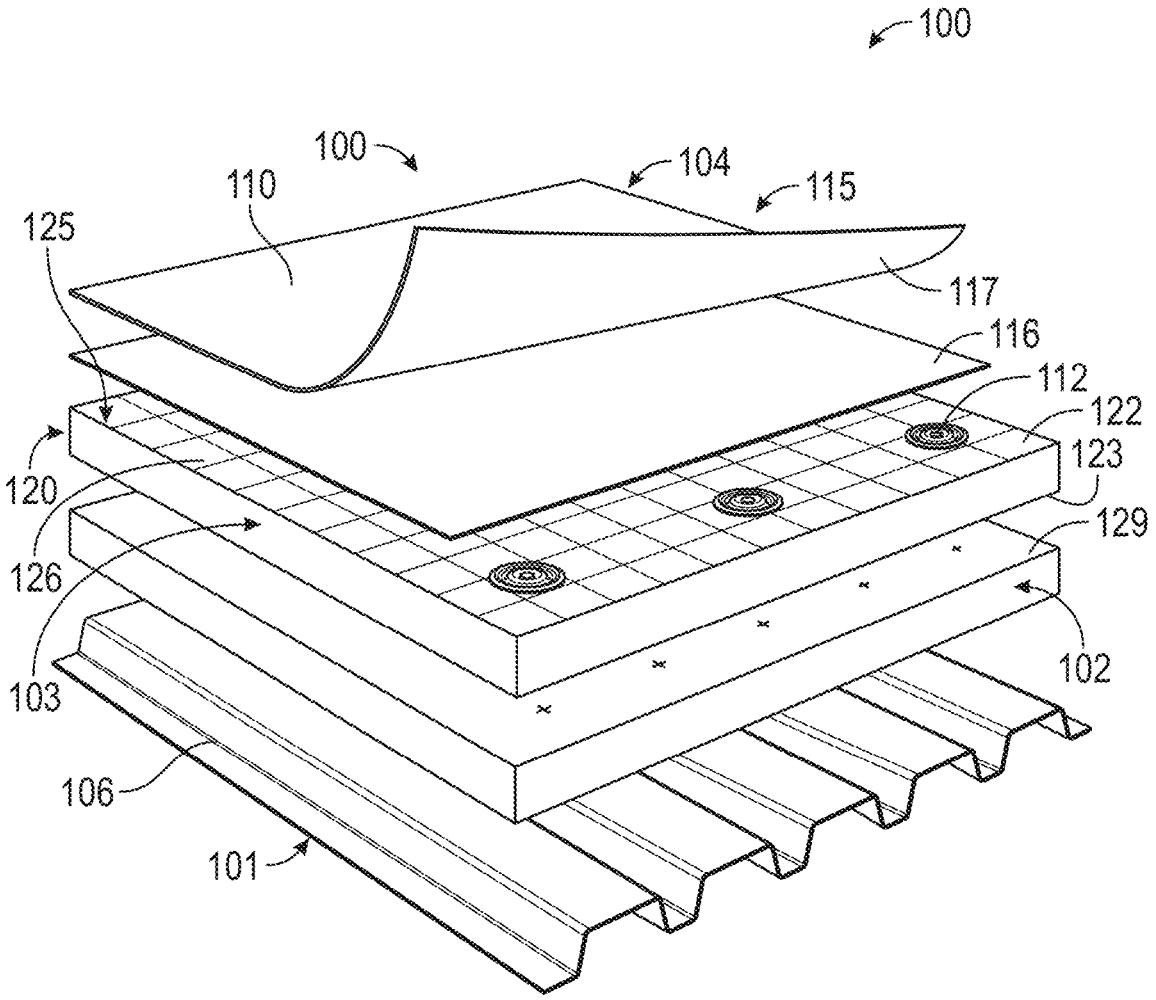
FIG. 6 is a perspective view illustrating still another embodiment of a roofing system including a reinforced insulation material layer and a modified bitumen sheet applied thereover according to the principles of the present disclosure.
Figure 7A:
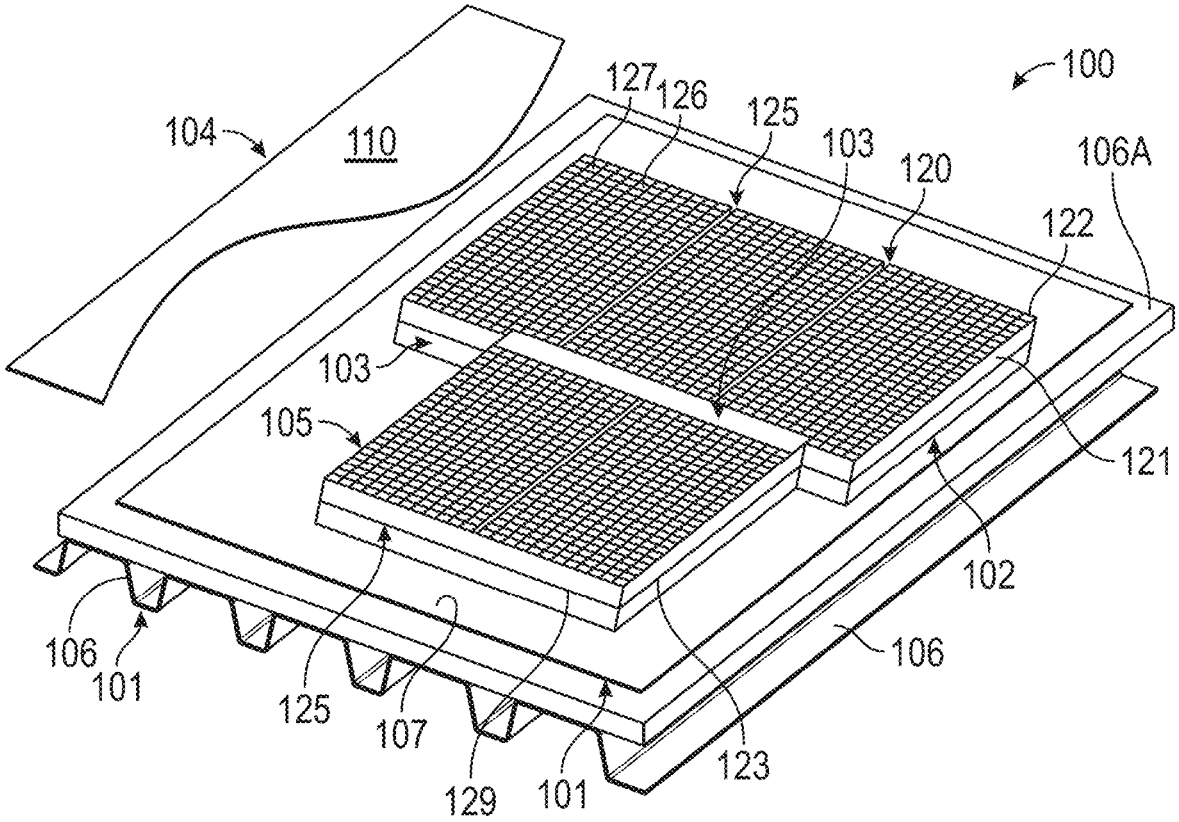
FIG. 7A illustrates an example of a roofing system including a roof deck, a plurality of insulation panels and reinforced insulation panels, and a membrane which roofing system is configured to meet the requirements for Very Severe Hail Resistance according to FM 4473 VSH Impact Resistance Testing Standard for Impact Resistance Testing of Rigid Roofing Materials by Impacting with Freezer Ice Balls, without a coverboard, according to embodiments of the present disclosure.
Figure 7B:
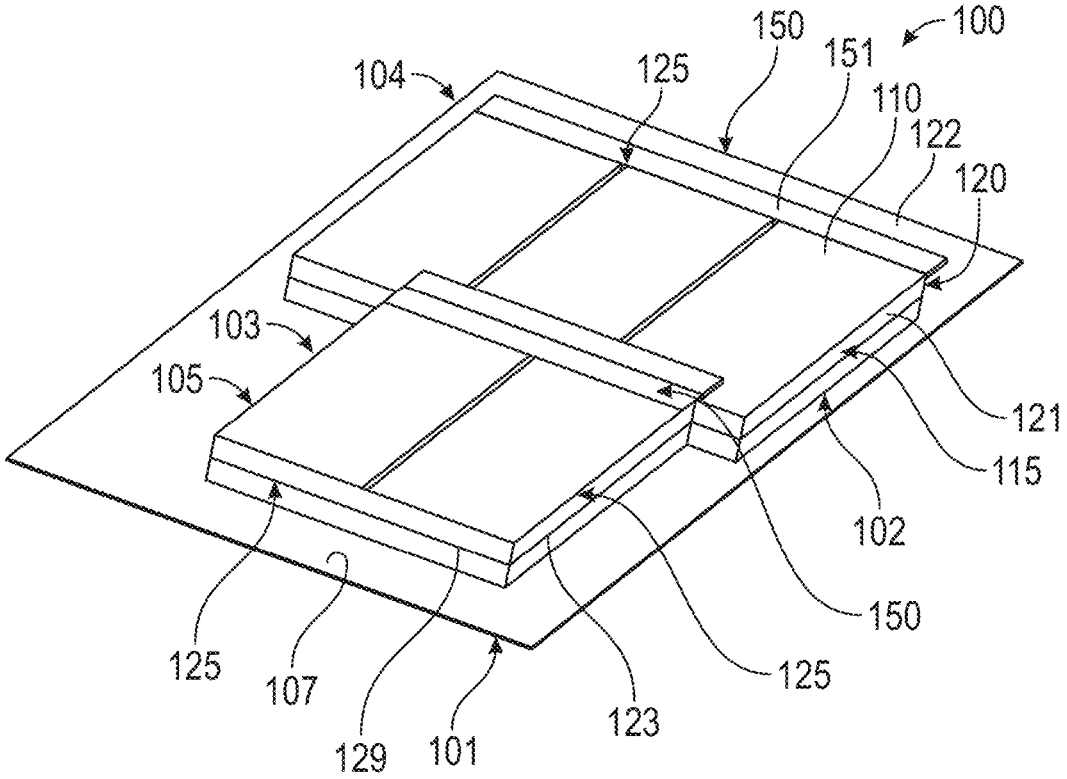
FIG. 7B illustrates an example of a roofing system including a roof deck, a plurality of insulation panels and reinforced insulation panels, and a membrane, in which the roofing system is configured to meet the requirements for Very Severe Hail Resistance according to FM 4473 VSH Impact Resistance Testing Standard for Impact Resistance Testing of Rigid Roofing Materials by Impacting with Freezer Ice Balls, without a coverboard, according to embodiments of the present disclosure.

FIGS. 1A-2B and 6-7B illustrate embodiments of a roof system 100 and components thereof in accordance with the principles of the present disclosure. In embodiments, the roofing system 100 can include a roof deck 101, a first layer 102 positioned above the roof deck 101, a second layer 103 positioned above the first layer 102, and a membrane 104 positioned above an upper surface 105 of the second layer 103. As indicated in FIGS. 2A-2B and 6, in embodiments, the first and second layers 102 and 103 can comprise insulation materials, and can be formed as sheets or panels, as shown in FIGS. 7A-7B, which can, in some embodiments, be stacked on top of each other and over the roof deck during installation of the roofing system 100; or, in other embodiments, rolled out or otherwise applied over an upper surface of the roof deck 101. The roofing system 100 further is configured to be installed without a coverboard.

In embodiments, the roof deck 101 can comprise a plurality of rafters or beams (e.g., as indicated at 106 in FIGS. 1A-1B); and in embodiments such as indicated in FIGS. 7A-7B, further can include a substrate or decking layer positioned on top of the roof beams or rafters. For example, in embodiments, a substrate or decking comprising metal, wood, concrete or other material panels, or combinations thereof, can be configured to support the other roofing system components, such as the first and second layers 102/103 and the membrane 104 thereover. In some embodiments, as shown in FIG. 1B, the first and second layers can be attached to the rafters or beams 106, or, in some embodiments such as shown in FIGS. 7A-7B, to a further supporting substrate 106A such as metal, wood, concrete or other material panels, by fasteners 112 (FIG. 1B). The fasteners 112 can be inserted through the first and second layers and penetrate into the roof deck, e.g., the beams or decking panels, to secure the first and second layers to the roof deck, after which the membrane 104 can be applied to the upper surface of the second layer, such as by adhesive materials being applied between the membrane and the upper surface of the second layer, or by heat welding, e.g., by torch applied heat.

In addition, in some embodiments such as indicated in FIG. 1A, a vapor barrier 107, can be positioned between the roof deck 101 and a lower surface of the first layer 102. In embodiments, the vapor barrier 107 can comprise a polymer membrane configured to inhibit passage of moisture into and through the roofing system from the interior of a building on which the roofing system 100 is installed.

In embodiments, the first layer 102 of the roofing system 100 can comprise a panel or sheet formed from a first insulation material. For example, in embodiments, the first insulation material can comprise polyisocyanurate, mineral wool, polyurethane, expanded polystyrene foam, extruded polystyrene foam, insulation materials including recycled materials, natural fibers, (such as wood or other fibers), or combinations thereof. In embodiments of a method for forming the roofing system, installation of the roofing system 100, as indicated in FIGS. 7A-7B, the first layer 102 can comprise a plurality of panels formed from the first insulation material, which are arranged in an array along the upper surface of the roof deck 101; or, in some embodiments, on top of a vapor barrier 107, as indicated in FIG. 1A.

In some embodiments, the first layer 102 can be provided with an expanded thickness configured to provide increased resistance to conductive heating therethrough. For example, a roofing system that includes a ½ inch to ⅝ inch coverboard for impact resistance and insulation properties, can have a resistance to conductive heat flow through the roofing system having an R-value of about R30. In embodiments, the roofing system 100 including the first and second layers 102 and 103 of insulation materials will be configured to provide a resistance to conductive heat flow through the roofing system having an R-value of at least R30, but with the thickness of the overall roofing system substantially matching the thickness of a roofing system having a coverboard positioned between the insulation and a membrane 104.

In embodiments, the first layer 102 can have a thickness of 1 inch to 2.6 inches; and, in embodiments, can have a thickness of 1 inch to 3.75 inches. In other embodiments, the first layer 102 can have a thickness of 1 inch to 3.65 inches, 1 inch to 3.6 inches, 1 inch to 3.5 inches, 1 inch to 3.4 inches, 1 inch to 3.3 inches, 1 inch to 3.2 inches, 1 inch to 3.1 inches, 1 inch to 3 inches, 1 inch to 2.9 inches, 1 inch to 2.8 inches. 1 inch to 2.7 inches, 1 inch to 2.6 inches, 1 inch to 2.5 inches, 1 inch to 2.4 inches, 1 inch to 2.3 inches, 1 inch to 2.2 inches, 1 inch to 2.1 inches, 1 inch to 2 inches, 1 inch to 1.9 inches, 1 inch to 1.8 inches, 1 inch to 1.7 inches, 1 inch to 1.6 inches, 1 inch to 1.5 inches, 1 inch to 1.4 inches, 1 inch to 1.3 inches, 1 inch to 1.2 inches, 1 inch to 1.1 inches.

In other embodiments, the first layer 102 can have a thickness of 1.5 inches to 3.75 inches, 1.5 inches to 3.65 inches, 1.5 inches to 3.6 inches, 1.5 inches to 3.5 inches, 1.5 inches to 3.4 inches, 1.5 inches to 3.3 inches, 1.5 inches to 3.2 inches, 1.5 inches to 3.1 inches, 1.5 inches to 3 inches, 1.5 inches to 2.9 inches, 1.5 inches to 2.8 inches, 1.5 inches to 2.7 inches, 1.5 inches to 2.6 inches, 1.5 inches to 2.5 inches, 1.5 inches to 2.4 inches, 1.5 inches to 2.3 inches, 1.5 inches to 2.2 inches, 1.5 inches to 2.1 inches, 1.5 inches to 2 inches, 1.5 inches to 1.9 inches, 1.5 inches to 1.8 inches, 1.5 inches to 1.7 inches, 1.5 inches to 1.6 inches. In other embodiments, the first layer can have a thickness of 2 inches to 3.75 inches, 2 inches to 3.65 inches, 2 inches to 3.6 inches, 2 inches to 3.5 inches, 2 inches to 3.4 inches, 2 inches to 3.3 inches, 2 inches to 3.2 inches, 2 inches to 3.1 inches, 2 inches to 3 inches, 2 inches to 2.9 inches, 2 inches to 2.8 inches, 2 inches to 2.7 inches, 2 inches to 2.6 inches, 2 inches to 2.5 inches, 2 inches to 2.4 inches, 2 inches to 2.3 inches, 2 inches to 2.2 inches, 2 inches to 2.1 inches.

In some embodiments, the first layer 102 can have a thickness of 2.5 inches to 3.75 inches, 2.5 inches to 3.65 inches, 2.5 inches to 3.6 inches, 2.5 inches to 3.5 inches, 2.5 inches to 3.4 inches, 2.5 inches to 3.3 inches, 2.5 inches to 3.2 inches, 2.5 inches to 3.1 inches, 2.5 inches to 3 inches, 2.5 inches to 2.9 inches, 2.5 inches to 2.8 inches, 2.5 inches to 2.7 inches, 2.5 inches to 2.6 inches. In addition, in embodiments, the first layer can have a thickness of 3 inches to 3.75 inches, 3 inches to 3.65 inches, 3 inches to 3.6 inches, 3 inches to 3.5 inches, 3 inches to 3.4 inches, 3 inches to 3.3 inches, 3 inches to 3.2 inches, or 3 inches to 3.1 inches. Other thicknesses also can be provided.

In other embodiments, the roofing system 100 can include an additional or third layer of an insulation material, such as indicated at 108 in FIG. 2B, applied to an upper surface 129 of the first layer to increase the thickness of insulation material of the first layer 102. For example, in embodiments, the first layer can have a thickness of 1 inch to 2.6 inches and the third layer 108, which can be formed from a similar insulation material as the first layer, can have a thickness of 0.1 inches to 1.0 inches to increase the thickness of the insulation material of the first layer by an additional, selected amount sufficient to help increase the resistance to conductive heat flow through the roofing system 100 to a value of at least R30, without substantially increasing the thickness of the roofing system as compared to a roofing system including a coverboard.

By way of example, in embodiments, the first layer 102 can have a thickness of, for example, 1 inch to 3.25 inches and an additional or third layer 108 of an insulation materials can be applied thereover, with the additional or third layer 108 having a thickness of about 0.5 inches so as to increase the total thickness of the insulation material provided by the first layer to 3-3.75 inches. In other embodiments, the additional or third layer 108 can have a thickness of 0.1 to 1 inches, 0.1 to 0.9 inches, 0.1 to 0.8 inches, 0.1 to 0.7 inches, 0.1 to 0.6 inches, 0.1 to 0.5 inches, 0.1 to 0.4 inches, 0.1 to 0.3 inches, 0.1 to 0.2 inches, 0.2 inch to 1 inch, 0.2 inch to 0.9 inch, 0.2 inch to 0.8 inch, 0.2 inch to 0.7 inch, 0.2 inch to 0.6 inch, 0.2 inch to 0.5 inch, 0.2 to 0.4 inch, 0.2 inch to 0.3 inch, 0.3 to 1 inch, 0.3 inch to 0.9 inch, 0.3 inch to 0.8 inch, 0.3 inch to 0.7 inch, 0.3 inch to 0.6 inch, 0.3 inch to 0.5 inch, 0.3 inch to 0.4 inch. Other thicknesses of such an additional or third layer also can be provided.

In addition, in some embodiments, the third layer 108 can be integrated with the first layer, such as being formed with or laminated to the first layer during manufacture of the first layer. In other embodiments, the third layer 108 can be separately adhered to the first layer 102, such as with an adhesive materials, e.g., during manufacture of the first layer, or in the field as part of the installation of the roofing system 100.

As further illustrated in FIGS. 1A-3B, in embodiments, the roofing system 100 includes a membrane 104 configured to cover the first and second layers 102/103 of insulation materials and the roof deck 101. In embodiments, the membrane 104 can be configured to seal the roofing system 100 so as to provide water proofing and/or water shedding properties (e.g., being configured to prevent the migration of water therethrough, and/or configure to direct water away from roof deck) to the roofing system 100. In addition, the membrane 104 also can be configured to provide other, additional properties to the roof structure such as UV resistance, additional impact resistance, fire retardant properties, and other properties.

In embodiments, the membrane 104 can comprise a thermoplastic polyolefin (TPO), an ethylene propylene diene monomer (EPDM), or a polyvinyl chloride (PVC) membrane including a single ply sheet material having a thickness of 20 mils to 120 mils and in some embodiments, a thickness of 20 mils to 110 mils, 20 mils to 100 mils, 20 mils to 90 mils, 20 mils to 80 mils, 20 mils to 70 mils, 20 mils to 60 mils, 20 mils to 50 mils, 20 mils to 40 mils, 20 mils to 30 mils, 30 mils to 120 mils, 30 mils to 110 mils, 30 mils to 100 mils, 30 mils to 90 mils, 30 mils to 80 mils, 30 mils to 70 mils, 30 mils to 60 mils, 30 mils to 50 mils, 30 mils to 40 mils, 40 mils to 120 mils, 40 mils to 110 mils, 40 mils to 100 mils, 40 mils to 90 mils, 40 mils to 80 mils, 40 mils to 70 mils, 40 mils to 60 mils, 40 mils to 50 mils, 50 mils to 120 mils, 50 mils to 110 mils, 50 mils to 100 mils, 50 mils to 90 mils, 50 mils to 80 mils, 50 mils to 70 mils, 50 mils to 60 mils, 60 mils to 120 mils, 60 mils to 110 mils, 60 mils to 100 mils, 60 mils to 90 mils, 60 mils to 80 mils, 60 mils to 70 mils, 70 mils to 120 mils, 70 mils to 110 mils, 70 mils to 100 mils, 70 mils to 90 mils, 70 mils to 80 mils, 80 mils to 120 mils, 80 mils to 110 mils, 80 mils to 100 mils, 80 mils to 90 mils, 90 mils to 120 mils, 90 mils to 110 mils, 90 mils to 100 mils, 100 mils to 120 mils 100 mils to 110 mils, or 110 mils to 120 mils. Other thicknesses of the membrane also can be used.

In addition, in embodiments, the membrane 104 can comprise a fleece backed TPO membrane, or a TPO membrane with a TPO or PVC adhesive attached EPDM silicone layer or other cushioning material configured to help absorb impacts from hail or other objects striking the upper surface of the membrane. In embodiments, the membrane 104 will define an upper, exposed surface 110 of the roofing system 100, configured to withstand exposure to weather (e.g., withstand exposure to sun, wind, rain, snow, extreme temperatures, extreme cold). In some embodiments, the upper surface of the membrane can be further coated with, for example, an asphalt material, and a covering material such as a plurality of granules applied thereto.

In still other embodiments, the membrane 104 can comprise a modified bitumen material. As indicated in FIG. 1B, in embodiments, a multi-ply modified bitumen material sheet 115 (e.g., a two ply sheet as shown in FIG. 1B) can be applied along the upper surface of the second layer; and in embodiments, can include a base sheet 116 and a cap sheet 117. In embodiments, the base sheet 116 can comprise a bituminous asphalt material, while the cap sheet 117 can comprise a polymeric material. For example, in embodiments, the cap sheet can comprise a TPO, EPDM, or PVC membrane, that is weather resistant.

In addition, in embodiments, a layer of granules can be applied over the membrane 104. For example, in embodiments, the upper surface of the cap sheet 117 can be coated with an asphalt material, and a plurality of granules applied over the cap sheet and being adhered thereto by the asphalt. The granules can be selected and applied to help increase reflectivity of sunlight. In other embodiments, granules may not be applied.

In some embodiments, the base sheet and the cap sheet can be attached or bonded together, such as by an adhesive, heat welding, or a combination thereof, or otherwise formed together as an integrated modified bitumen material sheet 115 to form the membrane 104. In still other embodiments, a single layer of a bituminous asphalt material (e.g., the base layer 116) that can be applied directly to the upper surface of the second layer 103, with the cap sheet 117 thereafter positioned over the layer of bituminous asphalt material, and attached thereto. In embodiments, the modified bitumen material sheet 115 can be applied over the upper surface of the second layer, and can be attached thereto by application of an adhesive material, which can include a hot adhesive such as a heated asphalt adhesive material, cold adhesives, or by heat welding, such as, for example, by use of a torch to apply heat to the modified bitumen material sheet 115.

For example, in embodiments, the base sheet can comprise a fibrous mat including a plurality of fibers such as glass or fiberglass fibers, carbon fibers, or other reinforcing fibers, impregnated with a polymeric material, e.g., a thermoplastic elastomer such as, styrene-butadiene-styrene. In embodiments, the cap sheet can comprise a mat formed from glass or fiberglass fibers and coated with asphalt. In some embodiments, other materials, including sheets formed from polymeric materials also can be used. In embodiments, the cap sheet further can include a face surfacing material along an upper surface thereof, e.g., in some embodiments, a plurality of granules can be applied to the upper surface of the cap sheet and adhered thereto by the asphalt coating. In embodiments, the upper surface of the base sheet can be coated with an adhesive, such as asphalt, or, in embodiments, a cold adhesive material, so as to adhere the base sheet to the cap sheet. In addition, in embodiments, a parting agent, such as silica (e.g., sand) can be applied to the upper surface of the base sheet or the lower surface of the cap sheet.

In embodiments, the modified bitumen material sheet 115 can have a thickness of 20 mils to 120 mils and in some embodiments, a thickness of 20 mils to 110 mils, 20 mils to 100 mils, 20 mils to 90 mils, 20 mils to 80 mils, 20 mils to 70 mils, 20 mils to 60 mils, 20 mils to 50 mils, 20 mils to 40 mils, 20 mils to 30 mils, 30 mils to 120 mils, 30 mils to 110 mils, 30 mils to 100 mils, 30 mils to 90 mils, 30 mils to 80 mils, 30 mils to 70 mils, 30 mils to 60 mils, 30 mils to 50 mils, 30 mils to 40 mils, 40 mils to 120 mils, 40 mils to 110 mils, 40 mils to 100 mils, 40 mils to 90 mils, 40 mils to 80 mils, 40 mils to 70 mils, 40 mils to 60 mils, 40 mils to 50 mils, 50 mils to 120 mils, 50 mils to 110 mils, 50 mils to 100 mils, 50 mils to 90 mils, 50 mils to 80 mils, 50 mils to 70 mils, 50 mils to 60 mils, 60 mils to 120 mils, 60 mils to 110 mils, 60 mils to 100 mils, 60 mils to 90 mils, 60 mils to 80 mils, 60 mils to 70 mils, 70 mils to 120 mils, 70 mils to 110 mils, 70 mils to 100 mils, 70 mils to 90 mils, 70 mils to 80 mils, 80 mils to 120 mils, 80 mils to 110 mils, 80 mils to 100 mils, 80 mils to 90 mils, 90 mils to 120 mils, 90 mils to 110 mils, 90 mils to 100 mils, 100 mils to 120 mils 100 mils to 110 mils, or 110 mils to 120 mils. Other thicknesses also could be used.

In embodiments, the second layer 103 can comprise a reinforced insulation material 120 formed according to the principles of the present disclosure; and in some embodiments, can comprise a pre-fabricated structural insulation component of the roofing system 100. In embodiments, the second layer can comprise sheets or panels that can be stacked over sheets of panels of the first layer 102, which includes the first insulation material, as shown in FIGS. 2A-5B.

In embodiments, the second layer 103 can have a thickness of 1 inch to 2.6 inches; and, in some embodiments, can have a thickness of 1 inch to 3.65 inches, 1 inch to 3.5 inches 1 inch to 3.4 inches, 1 inch to 3.3 inches, 1 inch to 3.2 inches, 1 inch to 3.1 inches, 1 inch to 3 inches, 1 inch to 2.9 inches, 1 inch to 2.8 inches. 1 inch to 2.7 inches, 1 inch to 2.6 inches, 1 inch to 2.5 inches, 1 inch to 2.4 inches, 1 inch to 2.3 inches, 1 inch to 2.2 inches, 1 inch to 2.1 inches, 1 inch to 2 inches, 1 inch to 1.9 inches, 1 inch to 1.8 inches, 1 inch to 1.7 inches, 1 inch to 1.6 inches, 1 inch to 1.5 inches, 1 inch to 1.4 inches, 1 inch to 1.3 inches, 1 inch to 1.2 inches, 1 inch to 1.1 inches.

In other embodiments, the second layer 103 can have a thickness of 1.5 inches to 3.65 inches, 1.5 inches to 3.6 inches, 1.5 inches to 3.5 inches, 1.5 inches to 3.4 inches, 1.5 inches to 3.3 inches, 1.5 inches to 3.2 inches, 1.5 inches to 3.1 inches, 1.5 inches to 3 inches, 1.5 inches to 2.9 inches, 1.5 inches to 2.8 inches, 1.5 inches to 2.7 inches, 1.5 inches to 2.6 inches, 1.5 inches to 2.5 inches, 1.5 inches to 2.4 inches, 1.5 inches to 2.3 inches, 1.5 inches to 2.2 inches, 1.5 inches to 2.1 inches, 1.5 inches to 2 inches, 1.5 inches to 1.9 inches, 1.5 inches to 1.8 inches, 1.5 inches to 1.7 inches, 1.5 inches to 1.6 inches.

In other embodiments, the second layer 103 can have a thickness of 2 inches to 3.65 inches, 2 inches to 3.6 inches, 2 inches to 3.5 inches, 2 inches to 3.4 inches, 2 inches to 3.3 inches, 2 inches to 3.2 inches, 2 inches to 3.1 inches, 2 inches to 3 inches, 2 inches to 2.9 inches, 2 inches to 2.8 inches, 2 inches to 2.7 inches, 2 inches to 2.6 inches, 2 inches to 2.5 inches, 2 inches to 2.4 inches, 2 inches to 2.3 inches, 2 inches to 2.2 inches, 2 inches to 2.1 inches. In some embodiments, the first layer can have a thickness of 2.5 inches to 3.6 inches, 2.5 inches to 3.5 inches, 2.5 inches to 3.4 inches, 2.5 inches to 3.3 inches, 2.5 inches to 3.2 inches, 2.5 inches to 3.1 inches, 2.5 inches to 3 inches, 2.5 inches to 2.9 inches, 2.5 inches to 2.8 inches, 2.5 inches to 2.7 inches, 2.5 inches to 2.6 inches. In addition, in embodiments, the first layer can have a thickness of 3 inches to 3.65 inches, 3 inches to 3.6 inches, 3 inches to 3.5 inches, 3 inches to 3.4 inches, 3 inches to 3.3 inches, 3 inches to 3.2 inches, or 3 inches to 3.1 inches. Other thicknesses also can be provided.

In embodiments, as shown in FIGS. 1A-1B, the reinforced insulation material 120 of the second layer 103 can include a substrate 121 having a first or upper surface 122 and a second or bottom surface 123. The substrate 121 will be formed from a second insulation material that, in embodiments, can comprise polyisocyanurate, polyurethane, mineral wool, expanded polystyrene foam, extended polystyrene foam, or combinations thereof. In embodiments, the second insulation material of the substrate 121 can be formed from the same material as the first insulation material of the first layer 102.

In embodiments, the substrate 121 can have a thickness of 1 inch to 3.0 inches. In other embodiments, the substrate 121 can have a thickness of 1 inch to 2.9 inches, 1 inch to 2.8 inches. 1 inch to 2.7 inches, 1 inch to 2.6 inches, 1 inch to 2.5 inches, 1 inch to 2.4 inches, 1 inch to 2.3 inches, 1 inch to 2.2 inches, 1 inch to 2.1 inches, 1 inch to 2 inches, 1 inch to 1.9 inches, 1 inch to 1.8 inches, 1 inch to 1.7 inches, 1 inch to 1.6 inches, 1 inch to 1.5 inches, 1 inch to 1.4 inches, 1 inch to 1.3 inches, 1 inch to 1.2 inches. In other embodiments, the second layer 103 can have a thickness of 1.5 inches to 3 inches, 1.5 inches to 2.9 inches, 1.5 inches to 2.8 inches, 1.5 inches to 2.7 inches, 1.5 inches to 2.6 inches, 1.5 inches to 2.5 inches, 1.5 inches to 2.4 inches, 1.5 inches to 2.3 inches, 1.5 inches to 2.2 inches, 1.5 inches to 2.1 inches, 1.5 inches to 2 inches, 1.5 inches to 1.9 inches, 1.5 inches to 1.8 inches, 1.5 inches to 1.7 inches, 1.5 inches to 1.6 inches. In other embodiments, the second layer 103 can have a thickness of 2 inches to 3 inches, 2 inches to 2.9 inches, 2 inches to 2.8 inches, 2 inches to 2.7 inches, 2 inches to 2.6 inches, 2 inches to 2.5 inches, 2 inches to 2.4 inches, 2 inches to 2.3 inches, 2 inches to 2.2 inches, 2 inches to 2.1 inches. In some embodiments, the second layer can have a thickness of 2.5 inches to 3 inches, 2.5 inches to 2.9 inches, 2.5 inches to 2.8 inches, 2.5 inches to 2.7 inches, 2.5 inches to 2.6 inches In embodiments, such as illustrated in FIGS. 1A-5B, the reinforced insulation material 120 of the second layer 103 further can include a reinforcing sublayer 125 applied to the first or upper surface 122 of the substrate. In embodiments, the reinforcing sublayer 125 is integrated with the substrate 121. For example, in embodiments, the reinforcing sublayer 125 can be pre-fabricated with the substrate, such as by being attached to the substrate (e.g., by adhesives, thermal bonding or a combination thereof), or being extruded with, molded with, or laminated to the first or upper surface 122 of the substrate.

In some embodiments, the insulation material substrate 121 of the reinforced insulation material, including a polyisocyanurate, polyurethane, polystyrene, or other insulation material, can be attached to the reinforcing sublayer as part of a direct foaming process of manufacturing the insulation material. In embodiments, the reinforcing sublayer can be formed into a sheet or scrim, such as by mixing a sheet molding compound with chopped reinforcing fibers (e.g., glass, fiberglass, natural fibers, polymer fibers such as polyester, carbon fibers, or other cut or chopped fibers) and forming the mixture into a sheet, or, in some embodiments, a plurality of continuous reinforcing fibers (e.g., glass, fiberglass, natural fibers, polymer fibers such as polyester, carbon fibers, or other cut or chopped fibers) can be mixed with a resin and extruded to form the fiber reinforced polymer composite sheet.

The fiber reinforced polymer composite sheet then can be moved along a processing path, along which a foam mixture, that, in embodiments, can include a polyisocyanurate and at least one isocyanate reactive compound deposited along the first surface of the fiber reinforced polymer composite sheet. As the polyisocyanurate and at least one isocyanate reactive compound of the foam mixture reacts and expands, the reinforcing sublayer 125 can be encapsulated with or bonded to the insulation substrate so as to thus be substantially integrated with the substrate and can define the upper surface 105 of the second layer 103.

Alternatively, in some embodiments, the fiber reinforced polymer composite sheet can be formed and moved along a processing path, and a substrate comprising an insulation material, such as polyisocyanurate, polyurethane, mineral wool, expanded polystyrene foam, extended polystyrene foam, or combinations thereof, can be positioned along one side surface of the fiber reinforced polymer composite sheet, and attached thereto to form the reinforced insulation material. For example, in embodiments, an adhesive material can be applied to at least one of the fiber reinforced polymer composite sheet or the substrate, such that as the fiber reinforced polymer composite sheet and the substrate are brought into registration together, they will be adhesively attached to form the reinforced composite insulation material 120. In embodiments, the adhesive material can include isocyanate terminated urethane polymers, methacrylate's, butyl-based adhesives, polymer modified asphaltic materials, polyurethane foams, rubber contact adhesives. Other adhesive materials also can be used.

After formation, in embodiments, the reinforced insulation material can be formed into rolls, or cut into panels which can be packaged for shipment. For example, packages having one or more rolls of reinforced insulation materials, or a plurality of reinforced insulation material panels 120 stacked together can be formed. In embodiments, such packages can include 5-10 reinforced insulation material panels. In some embodiments, the packages can include 5-9 panels, 5-8 panels, 5-7 panels, 5-6 panels, 6-10 panels, 6-9 panels, 6-8 panels, 6-7 panels, 7-10 panels, 7-9 panels, 7-8 panels, 8-10 panels, 8-9 panels, or 9-10 panels. Other numbers of panels also can be provided. Still further, in other embodiments, the reinforced insulation materials can be formed as other types of roofing materials, for example, shingles, tiles, or other materials, packaged together in stacks.

In embodiments, the packages can include additional components including a membrane 104 (e.g., a roll or sheets of TPO, EPDM, PVC, or Modified Bitumen) and an adhesive material. Alternatively, in some embodiments, the reinforced insulation panels of the packages can be provided with a membrane pre-fabricated or attached thereto, with or without an additional membrane material being provided as part of the packages. Still further, in some embodiments, a plurality of insulation panels, such as for forming the first layer 102, which do not include a fiber reinforced polymer composite sheet, also can be provided as part of the packages.

In embodiments, such as shown in FIGS. 1A-1B, and 6, the membrane 104, e.g., a TPO membrane, may be positioned over or attached to the reinforcing sublayer 125. In embodiments, the membrane 104 can be attached with a TPO or PVC adhesive. In some embodiments, such as where the membrane 104 includes a Modified Bitumen material 115 (FIG. 6), the bituminous asphalt of the base layer 116 can adhere the base layer and cap sheet of the Modified Bitumen material 115, with or without an additional adhesive being required.

In addition, in embodiments, the packages can further include one or more sensors adapted to measure temperature, impacts, penetration or leakage of water through the membrane. Other sensors or smart materials also can be provided. In embodiments, such sensors or smart materials can be applied to a surface of the reinforced insulation material; for example, placed along a surface of the reinforced insulation material (e.g., the upper surface) being inserted into the reinforced insulation material, adhered a surface of the reinforced insulation material, or combinations thereof, by installer in the field. Alternatively, in some embodiments, the packages can include reinforced insulation materials (e.g., a plurality of reinforced insulation panels) having one or more sensors integrated therewith. For example, the packages can include reinforced insulation panels with sensors attached to the second layer 103 during manufacture thereof, e.g., being laminated to the substrate, being embedded within the substrate, attached to the reinforcing sublayer, or combinations thereof, as part of the manufacturing process of the reinforced insulation panels. Still further, the packages can also include insulation panels 102 (without a reinforcing sublayer), which include one or more sensors.

Figure 3B:
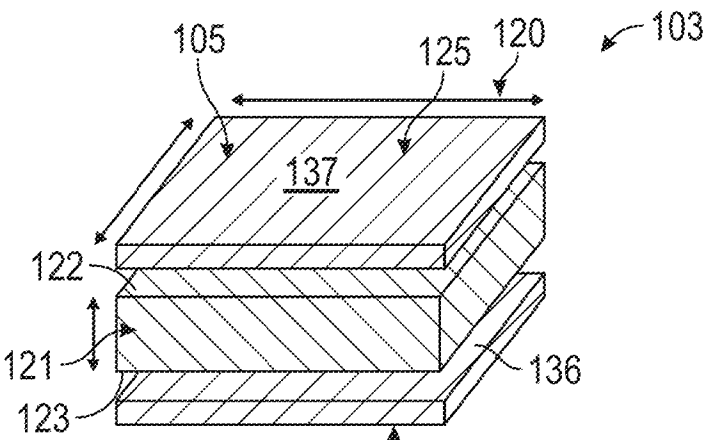
FIG. 3A and FIG. 3B are perspective views illustrating example embodiments of a reinforced insulation material according to the principles of the present disclosure.

In embodiments, as shown in FIG. 3B, the reinforcing sublayer 125 can be configured as a fiber reinforced polymer composite material 137 applied to the first or upper surface 122 of the substrate 121 to form a protective barrier layer integrated with the substrate such that the second layer 103 is configured to provide a resistance to cracking upon impact of an object thereagainst such that the roofing system exceeds the requirements of the FM 4473 testing Standard for Very Severe Hail certification. In addition, in embodiments, the fiber reinforced polymer composite material 137 can comprise a water impermeable skin (adapted to inhibit passage of water therethrough); and in some embodiments, the fiber reinforced polymer composite material 137 can provide additional insulative properties to the second layer, such that the roofing system 100 can be provided with a resistance to conductive heat flow through the roofing system having an R-value of greater than R30, without requiring the use of a coverboard for either very severe hail resistance or enhanced insulative properties, and without substantially increasing the overall thickness of the roofing system.

In embodiments, the fiber reinforced polymer composite material 137 can comprise a sheet formed by molding a plurality of reinforcing fibers 126 with a sheet molding compound. In other embodiments, the fiber reinforced polymer composite material 137 can comprise a sheet formed by a pultrusion process and including a resin and a plurality of substantially continuous reinforcing fibers. For example, in embodiments, the reinforcing fibers 126 can be mixed with a resin 127 comprising a polymer, a biodegradable material, low-carbon footprint material, or a combination thereof.

In embodiments, the fibers 126 and resin material 127 can be mixed in a selected ratio to form a skin or facer sheet of a selected thickness. By way of example only, in some embodiments, the resin and fibers can be mixed in a ratio of 10% fibers to 90% resin; and in other embodiments, can be mixed in a ratio of 10% fibers to 80% resin, 10% fibers to 70% resin, 10% fibers to 60% resin, 10% fibers to 50% resin, 10% fibers to 40% resin, 10% fibers to 30% resin, 10% fibers to 20% resin, 20% fibers to 90% resin, 20% fibers to 80% resin, 20% fibers to 70% resin, 20% fibers to 60% resin, 20% fibers to 50% resin, 20% fibers to 40% resin, 20% fibers to 30% resin, 30% fibers to 90% resin, 30% fibers to 80% resin, 30% fibers to 70% resin, 30% fibers to 60% resin, 30% fibers to 50% resin, 30% fibers to 40% resin, 40% fibers to 90% resin, 40% fibers to 80% resin, 40% fibers to 70% resin, 40% fibers to 60% resin, 40% fibers to 50% resin, 50% fibers to 90% resin, 50% fibers to 80% resin, 50% fibers to 70% resin, or 50% fibers to 60% resin. Other mixture ratios may also be used.

In some embodiments, fiber reinforced polymer composite material 137 can be formed as a sheet, and in some alternative embodiments can include a scrim having a plurality of reinforcing fibers 126 and a resin material 127 integrated therewith. The scrim material may comprise a woven material, non-woven material, mesh material, netting or belted materials, or combination thereof. The scrim material may further be comprised of polyester, glass, polyester/glass hybrid, nylon, polypropylene, or some combinations thereof. In addition, in embodiments, the scrim material of the fiber reinforced polymer composite material 137 may comprise various patterns, such as an over/under pattern, tri-directional pattern, quad-directional pattern, or some combination thereof.

In embodiments, the reinforcing fibers 126 can comprise a plurality of glass fibers, fiberglass fibers, carbon fibers, natural fibers, natural fibers (such as wood fibers and other natural fibers), or a combination thereof. For example, in embodiments, the reinforcing fibers 126 can include substantially continuous or chopped glass or carbon fibers, fiberglass filaments, or other reinforcing fibers that, when combined with appropriate resins, have a selected impact resistance.

In addition, in embodiments, the fiber reinforced polymer composite material 137 can comprise a thickness of 0.5 millimeter to 8 millimeters; and in some embodiments, a thickness of 0.5 millimeter to 7 millimeters, 0.5 millimeter to 6 millimeters, 0.5 millimeter to 5 millimeters, 0.5 millimeter to 4 millimeters, 0.5 millimeter to 3 millimeters, 0.5 millimeter to 2 millimeters, 0.5 millimeter to 1 millimeter, 1 millimeter to 8 millimeters, 1 millimeter to 7 millimeters, 1 millimeter to 6 millimeters, 1 millimeter to 5 millimeters, 1 millimeter to 4 millimeters, 1 millimeter to 3 millimeters, 1 millimeter to 2 millimeters, 2 millimeters to 8 millimeters, 2 millimeters to 7 millimeters, 2 millimeters to 6 millimeters, 2 millimeters to 5 millimeters, 2 millimeters to 4 millimeters, 2 millimeters to 3 millimeters, 3 millimeters to 8 millimeters, 3 millimeters to 7 millimeters, 3 millimeters to 6 millimeters, 3 millimeters to 5 millimeters, 3 millimeters to 4 millimeters, 4 millimeters to 8 millimeters, 4 millimeters to 7 millimeters, 4 millimeters to 6 millimeters, 4 millimeters to 5 millimeters, 5 millimeters to 8 millimeters, 5 millimeters to 7 millimeters, 5 millimeters to 6 millimeters, 6 millimeters to 8 millimeters, 6 millimeters to 7 millimeters, or 7 millimeters to 8 millimeters. Other thicknesses of the fiber reinforced polymer composite material also can be used.

Further, in some embodiments, an additional reinforcing sublayer 128 (FIG. 2B) can be applied to the second surface 123 of the substrate 121. In embodiments, the additional reinforcing sublayer 128 can comprise a fiber reinforced skin or reinforced sheet material that is different from the fiber reinforced polymer composite skin positioned along the first or upper surface 122 of the substrate 121. For example, in embodiments, the additional reinforcing sublayer 128 can comprise a facer comprising a mesh, scrim, fabric, paper, of a combination thereof, and which further can include reinforcing materials such as glass fibers.

FIGS. 3A-5B illustrate additional, non-limiting example embodiments of a reinforcing insulation material 120 for use as the second layer 103 of the insulation in the roofing system 100 according to the principles of the present disclosure.

Figure 3A:
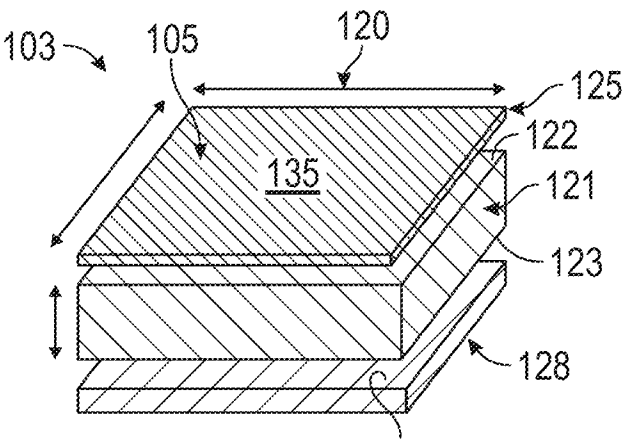

In one example embodiment, shown in FIG. 3A, the reinforced insulation material 120 can include a substrate 121 having a first surface 122 and second surface 123. In embodiments, the substrate 121 can comprise a polyisocyanurate insulation material, such as GAF Energy Guard™ polyiso insulation, from GAF of Parsippany, New Jersey. In embodiments, first reinforcing sublayer 125 can be applied to the first surface 122 of the substrate, defining the upper surface 105 of the second layer 103 and, in some embodiments, an additional, second reinforcing sublayer 128 can be applied to the second surface 123 of the substrate, e.g., as illustrated in FIGS. 3A-3B.

In embodiments, such as shown in FIG. 3A, the first reinforcing sublayer 125 can comprise a glass-coated facer 135, which, in some embodiments, further can comprise a glass-coated fiberglass facer. In embodiments, the first reinforcing sublayer further can include a mesh or scrim, with a coating mixture of a polymer and a plurality of reinforcing fibers applied thereto. In embodiments, the glass-coated facer 135 can have a thickness of 0.5 millimeter to 2 millimeters, 0.5 millimeter to 1.75 millimeter, 0.5 millimeter to 1.5 millimeter, 5 millimeter to 1 millimeter, 0.5 millimeter to 0.75 millimeter, 1 millimeter to 2 millimeters, 1 millimeter to 1.75 millimeter, 1 millimeter to 1.5 millimeter, 1.5 millimeter to 2 millimeter, 1.5 millimeter to 1.75 millimeter, 1.75 millimeter to 2 millimeters, or other thicknesses.

In addition, in embodiments, the second reinforcing layer 128 can comprise a reinforced polymer composite material skin 136 that is applied along the second surface of the substrate opposite the first reinforcing sublayer, as shown in FIGS. 3A-3B. In other embodiments, the first reinforcing sublayer 125 also can comprise a reinforced polymer composite material 137, (FIG. 3B). In embodiments, the first reinforcing sublayer and the second reinforcing layer can comprise a similar reinforced polymer composite material. In some embodiments, the fiber reinforced polymer composite material skin 136 of the second reinforcing sublayer 128 can be formed from a different fiber reinforced polymer composite material than the fiber reinforced polymer composite material skin 137 of the first reinforcing sublayer 125.

In embodiments, one or both of the first and second reinforcing sublayers 125 and 128 can be formed with the substrate 121. For example, in embodiments, one or both of the first and second reinforcing layers can be formed with the substrate as part of a direct foaming process wherein, during formation of the substrate, the polyisocyanurate insulation material of the substrate is directly formed onto the first and/or second reinforcing sublayers, so as to form the integrated reinforced insulation material 120.

Figure 4B:
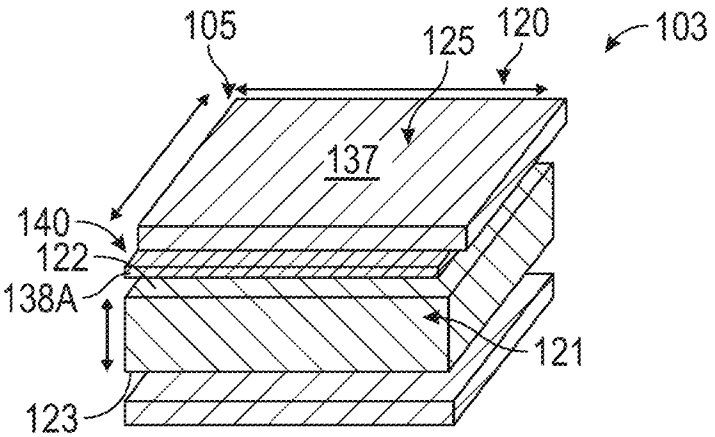
FIG. 4A and FIG. 4B are perspective views illustrating additional example embodiments of a reinforced insulation material according to the principles of the present disclosure.
Figure 4A:
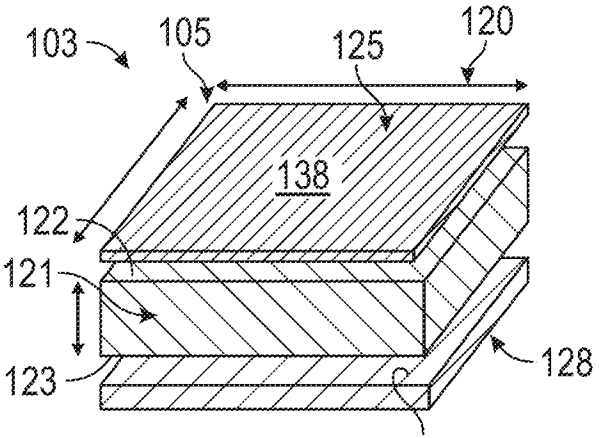

FIGS. 4A-4B illustrate still another embodiment of a reinforced insulation material 120 that can be used as the second layer 103 of insulation material of the roofing system 100 according to the principles of the present disclosure. As illustrated in FIGS. 4A-4B, the reinforced insulation material 120 can include a substrate 121, which, in embodiments, can be formed from a polyisocyanurate insulation material, such as GAF Energy Guard™ polyiso insulation from GAF of Parsippany, New Jersey. In embodiments, the substrate 121 can include a first surface 122 and a second surface 123, with a first reinforcing sublayer 125 applied to the first surface 122, defining the upper surface 105 of the second layer 103; and in some embodiments, a second or additional reinforcing sublayer 128 applied to the second surface 123 of the substrate. In embodiments, the first and second reinforcing sublayers can be formed with or otherwise integrated with the substrate during formation of the substrate, such as by a direct foaming process.

In one example embodiment shown in FIG. 4A, the first reinforcing sublayer 125 can comprise a Kraft-paper facer material, indicated at 138, and the second reinforcing sublayer can comprise a fiber reinforced polymer material skin 136. In other embodiments, such as shown in FIG. 4B, the first reinforcing sublayer 125 can include a fiber reinforced polymer composite material skin 137. In embodiments, the first reinforcing sublayer and the second reinforcing sublayer can comprise a similar fiber reinforced polymer composite material. In other embodiments, the first and second reinforcing sublayers can comprise different fiber reinforced polymer composite materials. In addition, in some embodiments, a facer 138A, e.g., a Kraft-paper facer or other, similar facer, also can be applied to the first surface 122 of the substrate, being positioned between the substrate and the first reinforcing sublayer, as indicated in FIG. 4B.

Figure 5B:
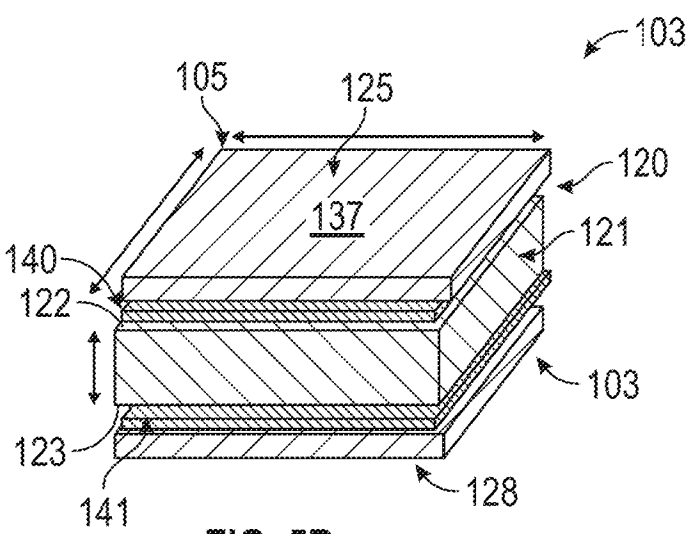
FIG. 5A and FIG. 5B are perspective views illustrating further example embodiments of a reinforced insulation material according to the principles of the present disclosure.
Figure 5A:
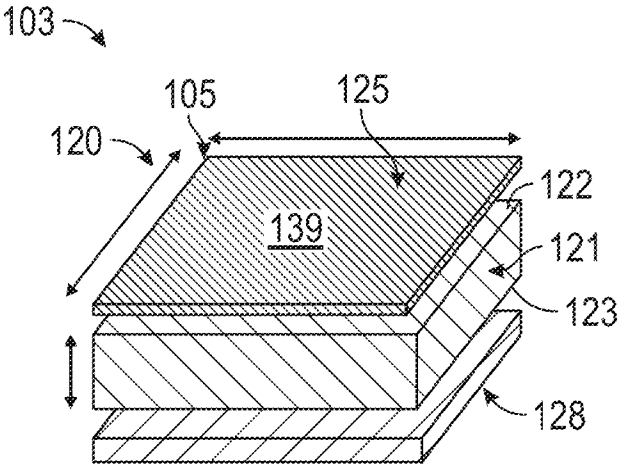

FIGS. 5A and 5B illustrate still further embodiments of a reinforced insulation material 120 for use as the second layer 103 of insulation material of the roofing system 100 according to the principles of the present disclosure. As illustrated in FIGS. 5A and 5B, the reinforced insulation material 120 can include a substrate 121 that can be formed from a polyisocyanurate insulation material, such as GAF Energy Guard™ polyiso insulation from GAF of Parsippany, New Jersey. In embodiments, the substrate 121 will include a first surface 122 and a second surface 123, with a first reinforcing sublayer 125 being applied to the first surface, defining the upper surface 105 of the second layer 103; and, in some embodiments, a second reinforcing sublayer 128 can be applied to the second surface 123 of the substrate. In embodiments, the first and second reinforcing sublayers can be formed with or otherwise integrated with the substrate such as during a direct foaming process for formation of the substrate, wherein the substrate is formed onto the first and/or second reinforcing sublayers.

In an example embodiment shown in FIG. 5A, the first reinforcing sublayer can comprise a glass fiber mat 139 having a reinforced scrim or mesh material; for example, a fiber reinforced scrim or mesh having a plurality of reinforcing fibers integrated with a mat of glass fibers mixed with a polymer resin material, forming glass fiber reinforced polymer composite material skin applied along the upper surface of the substrate. As illustrated in FIG. 5A, in embodiments, the second reinforcing sublayer 128 can comprise a fiber reinforced polymer composite material skin 136. As illustrated in FIG. 5B, in embodiments, the first reinforcing sublayer 125 and the second reinforcing sublayer 128 can each comprise a fiber reinforced polymer composite material 137. In embodiments, the first reinforcing sublayer and the second reinforcing sublayer can comprise a similar fiber reinforced polymer composite material. In other embodiments, the first and second reinforcing sublayers can comprise different fiber reinforced polymer composite materials.

As further illustrated in FIGS. 4B and 5B, in some embodiments, an additional sublayer 140 can be positioned between the first surface 122 of the substrate and the first reinforcing sublayer 125; and, in some embodiments, can comprise a third reinforcing sublayer. In some embodiments, such as shown in FIG. 5B, another sublayer 141 can be positioned between the second surface 123 of the substrate 121 and the second reinforcing sublayer 128; and, in some embodiments, can comprise a fourth reinforcing sublayer. In embodiments, the sublayers 140 and 141 can each comprise a fiber reinforced mat material. For example, in embodiments, the additional sublayers 140 and 141 can comprise a glass fiber mat supported by a reinforced scrim or mesh material, e.g., a scrim or mesh including a plurality of reinforcing fibers mixed with a polymer resin material, for example, including a latex material. In other embodiments, the additional sublayers 140 and 141 can comprise different materials, e.g., a facer such as a kraft-paper facer as indicated in FIG. 4B, a glass-coated facer, as well as other reinforcing materials and materials configured to provide additional protection against passage of water, insulation properties, and other properties.

In embodiments, the fiber reinforced polymer composite material skins 137 and 136 of the first and second reinforcing sublayers 125 and 128 shown in the embodiments of FIGS. 3B and 4B can each comprise a thickness of 1 millimeter to 8 millimeters, in some embodiments, a thickness of 1 millimeter to 7 millimeters, 1 millimeter to 6 millimeters, 1 millimeter to 5 millimeters, 1 millimeter to 4 millimeters, 1 millimeter to 3 millimeters, 1 millimeter to 2 millimeters, 2 millimeters to 8 millimeters, 2 millimeters to 7 millimeters, 2 millimeters to 6 millimeters, 2 millimeters to 5 millimeters, 2 millimeters to 4 millimeters, 2 millimeters to 3 millimeters, 3 millimeters to 8 millimeters, 3 millimeters to 7 millimeters, 3 millimeters to 6 millimeters, 3 millimeters to 5 millimeters, 3 millimeters to 4 millimeters, 4 millimeters to 8 millimeters, 4 millimeters to 7 millimeters, 4 millimeters to 6 millimeters, 4 millimeters to 5 millimeters, 5 millimeters to 8 millimeters, 5 millimeters to 7 millimeters, 5 millimeters to 6 millimeters, 6 millimeters to 8 millimeters, 6 millimeters to 7 millimeters, or 7 millimeters to 8 millimeters. Other thicknesses of the fiber reinforced polymer composite material skins of the first and second reinforcing sublayers also can be used.

In addition, in some embodiments, such as indicated in FIGS. 3B, 4B, and 5B, the first reinforcing sublayer 125 can have a thickness that is different from a thickness of the second reinforcing sublayer. In some embodiments, the first reinforcing sublayer can have a thickness that is greater than the thickness of the second reinforcing sublayer.

For example, as indicated in FIGS. 4B and 5B, in embodiments, the first reinforcing sublayer 125 can have a thickness of 2 millimeters to 8 millimeters; and in some embodiments, can have a thickness of 2 millimeters to 7 millimeters, 2 millimeters to 6 millimeters, 2 millimeters to 5 millimeters, 2 millimeters to 4 millimeters, 2 millimeters to 3 millimeters; while, in embodiments, the second reinforcing sublayer can comprise a thickness of 0.5 millimeter to 3 millimeters, 0.5 millimeter to 2.5 millimeters, 0.5 millimeter to 2 millimeters, 0.5 millimeter to 1.5 millimeters, 0.5 millimeter to 1 millimeter, 1 millimeter to 3 millimeters, 1 millimeter to 2.5 millimeters, 1 millimeter to 2 millimeters, 1 millimeter to 1.5 millimeters, 1.5 millimeters to 3 millimeters, 1.5 millimeters to 2.5 millimeters, 1.5 millimeters to 2 millimeters, 2 millimeters to 3 millimeters, or 2.5 millimeters to 3 millimeters. Other thicknesses also can be used.

In addition, in some embodiments, one or more smart materials and sensors also can be integrated into the second layer. For example, sensors adapted to measure temperature, impacts, penetration or leakage of water through the membrane, and other sensors can be provided. Such sensors or smart materials can be integrated with the second layer 103 during manufacture thereof, e.g., being embedded into or laminated to the substrate with the reinforcing sublayer, or, in some embodiments, can be applied along a surface, of the reinforcing sublayer (e.g., the upper surface thereof) prior to installation of the membrane in the field. In embodiments, sensors also can be provided as part of a package of roofing materials, which, in some embodiments, could include one or more rolls or panels or roofing materials, e.g., including a plurality of reinforced insulation sheets, panels, shingles, tiles, etc., with sensors integrated therewith.

In FIGS. 7A-7B, example of a roofing system 100 according to the principles of the present disclosure are illustrated. In an embodiment, a method of installing the roofing system 100 includes a roof deck 101, and the method of installing the roofing system 100 includes positioning a first layer 102 comprising a first insulation material on top of the roof deck. As shown in FIGS. 7A-7B, the roof deck can include a substrate or decking, which, in embodiments, can comprise metal, wood, concrete or other material panels, beams or rafters, or combinations thereof, and which will be configured to support the other roofing system components. In some embodiments, a vapor barrier 107 also can be first applied along the roof deck prior to positioning the first layer 102 therealong. The first layer 102 can be secured over the roof deck 101 by adhesive, mechanical fasteners (e.g., fasteners 112 as shown in FIG. 1B), or other attachments. In addition, as indicated in FIGS. 2A, 3B, 4B and 5B, the first layer 102 can be provided with an additional thickness; while in some embodiments, an additional or third layer of insulation can be attached to the first layer.

Thereafter, a second layer 103 comprising a second insulation material, e.g., the reinforced insulation material 120, is applied over the first layer 102. In embodiments, a layer of an adhesive material will be applied to an upper surface 129 of the first layer 102 for attaching the first layer 102 to the second layer 103. In embodiments, such as shown in FIG. 1B, the first and second layers 102/103 can be attached to the roof deck by fasteners 112; or, in some embodiments, by an adhesive material. Thereafter, an adhesive material 131 configured to attach the membrane 104 to the reinforcing sublayer 125 of the second layer can be applied along the upper surface of the second layer 103, as indicated in FIG. 1A. For example, in embodiments, the adhesive material can include TPO or PVC adhesives, isocyanate terminated urethane polymers, methacrylate's, butyl-based adhesives, polymer modified asphaltic materials, polyurethane foams, rubber contact adhesives, or combinations thereof As shown in FIG. 7A, in embodiments, the first and second layers 102/103 can comprise a plurality of panels arranged in stacked series on top of the roof deck 101. The panels of the first and second layers further can be arranged in an array of rows and columns across and along the roof deck, and, in some embodiments, can be arranged in a staggered or offset arrangement. In some additional embodiments, a further sealing material such as a tape or similar material also can be applied along the seams or joints defined by abutting edges of adjacent panels.

Alternatively, in embodiments where the reinforced insulation panels each include a TPO, EPDM, PVC, or modified Bitumen membrane pre-attached to the upper surfaces thereof. For example, in embodiments, as illustrated in FIG. 7B, the membrane 109 can be pre-applied to each of the reinforced insulation panels 120 as a sheet 150; and in embodiments, further can include a flange portion 151 that projects from one or more of the peripheral edges of each of the reinforced insulation panels. The flange portions 151 can be configured to overlap an upper surface of one or more adjacent reinforced insulation panels 120, such as overlapping and lying against an upper surface 110 of the membrane 104 of the one or more adjacent reinforced insulation panels. In embodiments, the flanges 151 can be secured to the upper surfaces of the one or more adjacent reinforced insulation panels by adhesives, heat welding, tape, or a combination thereof.

Figure 8:
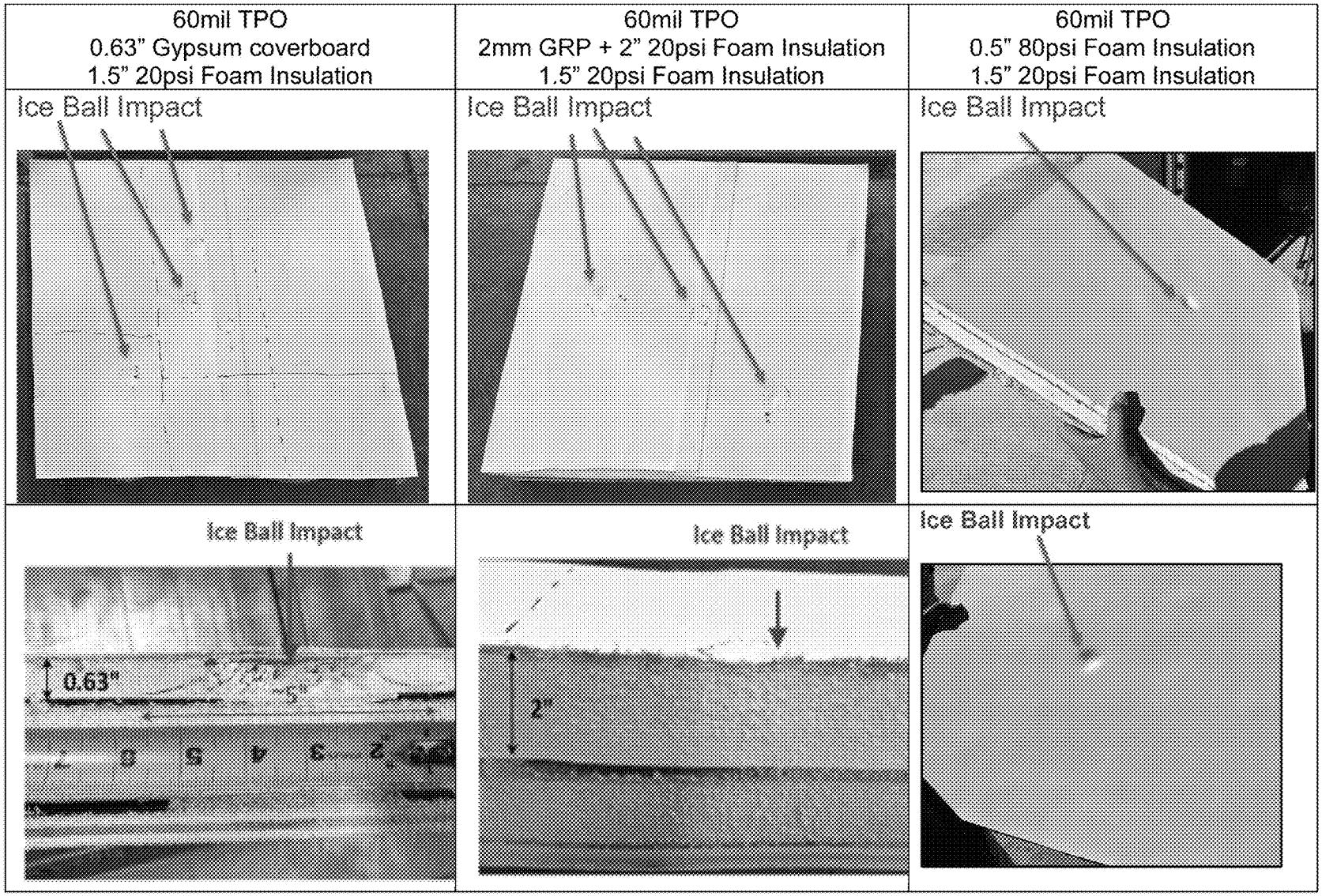
FIG. 8 illustrates results of comparison testing between an example embodiment of a roofing system incorporating a reinforced insulation material and without a coverboard according to the present disclosure, a roofing system including a conventional coverboard, and a roofing system including a layer of a high density foam insulation, after the roofing systems were subjected to testing in accordance with the FM 4473 VSH Impact Resistance Testing Standard for Impact Resistance Testing of Rigid Roofing Materials by Impacting with Freezer Ice Balls.

FIG. 8 illustrates a comparison of roofing systems being subjected to impacts from ice balls striking the surface of each roofing system. The roofing systems compared in FIG. 8 include an example roofing system constructed in accordance with embodiments of the present disclosure (shown in the center column) and including a 60 mil TPO single ply membrane applied over a 2 mm glass fiber reinforced polymer (GRP) sublayer+2" thick 20 psi foam insulation material formed according to the present disclosure (in the present embodiment comprising a 2" thick substrate of a polyisocyanurate insulation material with a minimum compressive strength of 20 psi, having a glass fiber reinforced polymer (GRP) sublayer applied thereto), and a 1.5" thick 20 psi foam insulation material positioned on a plywood roof deck, and without having a coverboard (shown in the center column). This roofing system was compared to an example roofing system (shown in the left column) including a 60 mil TPO single ply membrane applied over a 0.63" (⅝") thick gypsum coverboard, such as used in conventional roofing systems, and a 1.5" thick 20 psi foam insulation positioned on a plywood roof deck; and to another roofing system (shown in the right column) including a 60 mil TPO single ply membrane applied over a 0.5" thick 80 psi foam insulation material (a high density foam insulation material having a minimum compressive strength of 80 psi), and a 1.5" thick 20 psi foam insulation material positioned on a plywood roof deck.

Each of the roofing systems shown in FIG. 8, was subjected to impact test conditions in accordance with the FM 4473 testing standard for Very Severe Hail Resistance, during which the roofing systems were impacted with 2-inch ice balls propelled at 152-160 feet per second, with the ice balls striking the roofing systems with an impact force or energy of approximately 80J (58 ft-lb). As indicated in the photos in the left column, the roofing system including the 0.63" (⅝") gypsum coverboard showed signs of damage after impact with a 2" ice ball, including indentions formed within the upper surface of the membrane (shown in the top photo in the left column) and damage, including cracking, of the coverboard itself (shown in the lower photo of the left column). The roofing system including the 0.5" 80 psi foam insulation likewise showed visible damage in the form of deep depressions (shown in the photos of the right column). By contrast, as shown by the photos in the center column of FIG. 8, the roofing system formed according to the principles of the present disclosure, including the 2 mm GRP+2" foam insulation material without a coverboard, showed minimal impressions or signs of impact and no substantial signs of cracking as found with the other roofing systems including either a coverboard or a 0.5" 80 psi high density foam insulation.

Figure 9:
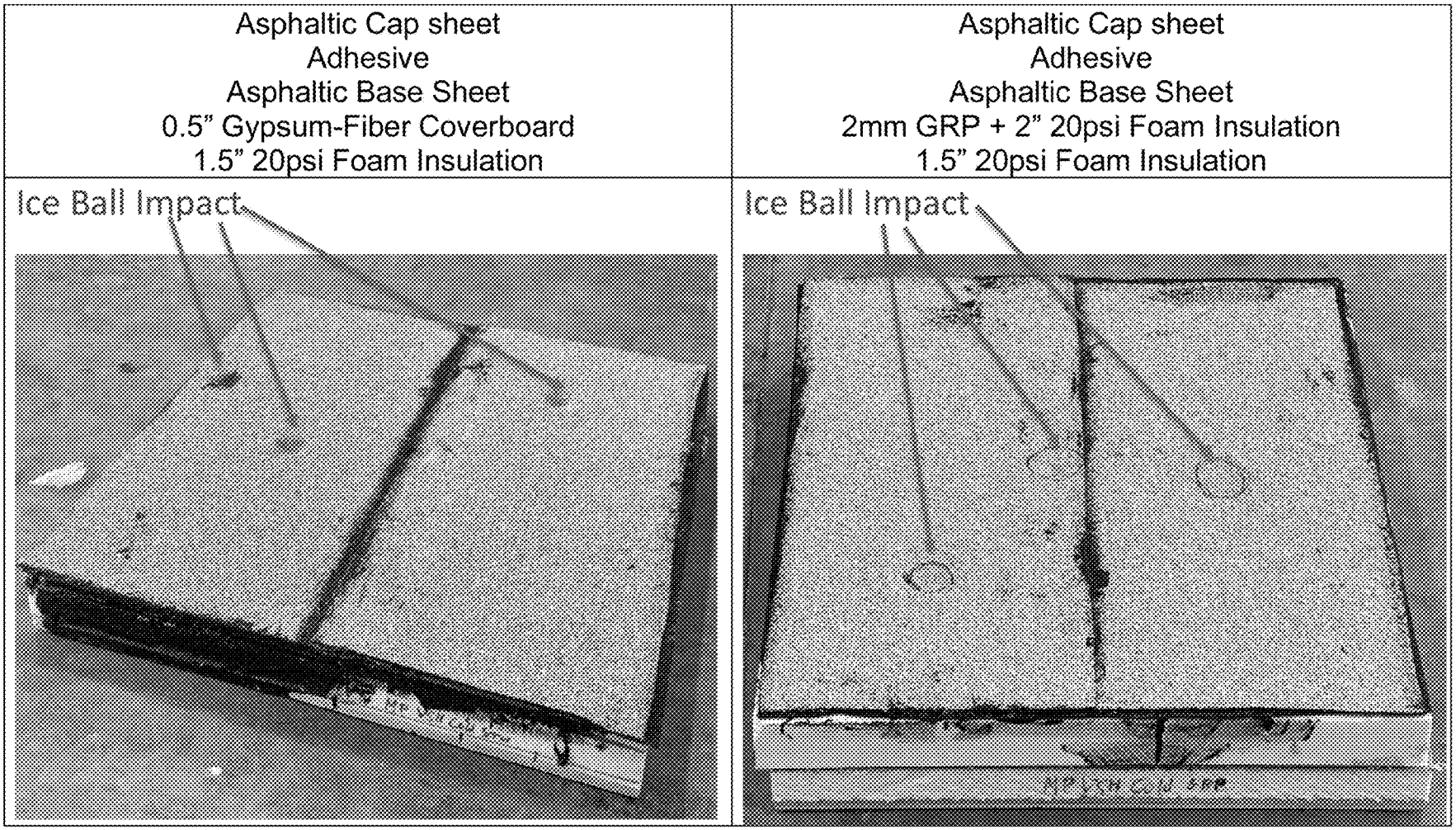
FIG. 9 illustrates results of comparison testing between a modified bitumen roofing system including a coverboard and a modified bitumen roofing system constructed without a coverboard and utilizing a reinforced insulation material according to the principles of the present disclosure, after the roofing systems were subjected to testing in accordance with the FM 4473 VSH Impact Resistance Testing Standard for Impact Resistance Testing of Rigid Roofing Materials by Impacting with Freezer Ice Balls.

In addition, FIG. 9 illustrates the results of a comparison test of modified bitumen roofing systems, including an example roofing system having a coverboard (a 0.5" thick gypsum fiber coverboard) and a modified bitumen membrane material, versus a modified bitumen roofing system constructed in accordance with the principles of the present disclosure, including a glass fiber reinforced polymer composite (GRP) insulation material without a coverboard.

The conventional roofing system example (shown on the left) included a 0.5" thick plywood deck, a 1.5" 20 psi foam insulation material applied over the plywood deck, a 0.5" gypsum coverboard adhered to the upper surface of the 1.5" 20 psi foam insulation, and a modified bitumen material (including an asphaltic base sheet and an asphaltic cap sheet attached to the base sheet with an adhesive) attached to the upper surface of the coverboard with a cold applied membrane adhesive. A plurality of granules further was adhesively attached to the upper surface of the cap sheet of the two-ply modified bitumen material. The roofing system formed according to the principles of the present disclosure (shown on the right) did not include a coverboard, and comprised a 0.5" plywood deck, a 1.5" 20 psi foam insulation applied over the plywood deck, a reinforced insulation material including a 2 mm GRP+2" 20 psi foam insulation material, formed in accordance with embodiments of the present disclosure, applied to the upper surface of the 1.5" 20 psi foam insulation material, and a modified bitumen material (including an asphaltic base sheet and an asphaltic cap sheet attached to the base sheet with an adhesive) attached to the upper surface of the reinforced insulation panel with a cold applied membrane adhesive material. In addition, a plurality of granules was adhesively attached to the upper surface of cap sheet of the modified bitumen material.

Both roofing systems were subjected to testing in accordance with the FM 4473 testing standard for Very Severe Hail Resistance, during which the roofing systems were impacted by 2" ice balls propelled at 152-160 feet per second, the ice balls striking the roofing systems with an impact force or energy of approximately 80J (58 ft-lb). As can be seen in FIG. 9, the conventional roofing system using a coverboard showed visible impact damage in the form of holes and deep depressions in the exposed surface thereof. By contrast, the roofing system formed according to the principles of the present disclosure, using a 2 mm GRP+2" 20 psi foam insulation material, and without using a coverboard, showed minimal visible impact damage.

The foregoing description generally illustrates and describes various embodiments of the present disclosure. It will, however, be understood by those skilled in the art that various changes and modifications can be made to the above-discussed construction of the present disclosure without departing from the spirit and scope of the present disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the present disclosure, and numerous variations, modifications, and additions further can be made thereto without departing from the spirit and scope of the present disclosure.

The invention claimed is:

1. A roofing system, comprising:

a roof deck;

a first layer positioned above the roof deck, the first layer comprising a first insulation material;

a second layer positioned above the first layer, the second layer comprising:

a substrate comprising a second insulation material; and a reinforcing sublayer integrated with the substrate defining an upper surface of the second layer opposite the first layer;

wherein the reinforcing sublayer comprises a fiber reinforced polymer composite material;

wherein the fiber reinforced polymer composite material comprises a plurality of glass fibers, carbon fibers, natural fibers, or a combination thereof mixed with a resin; and a membrane positioned above the upper surface of the second layer;

wherein the roofing system does not include a separate coverboard layer between the second layer and the membrane.

2. The roofing system of claim 1, further comprising an adhesive applied between the membrane and the upper surf ace of the second layer and configured to attach the membrane to the fiber reinforced polymer composite material of the reinforcing sublayer.

3. The roofing system of claim 1, wherein the second layer is configured to provide a resistance cracking upon impact of an object thereagainst such that the roofing system exceeds requirements for Very Severe Hail Resistance according to Is FM 4473 VSH Impact Resistance Testing Standard for Impact Resistance Testing Standard for Impact Resistance Testing of Rigid Roofing Materials by Impacting with Freezer Ice Balls.

4. The roofing system of claim 1, wherein the resin comprises a polymer, a biodegradable material, low-carbon footprint material, or a combination thereof.

5. The roofing system of claim 1, wherein the fiber reinforced polymer composite material comprises a skin having a thickness of 1 mm to 8 mm.

6. The roofing system of claim 1, wherein the fiber reinforced polymer composite comprises a sheet material molded composite.

7. The roofing system of claim 1, wherein the second layer further comprises a base sheet adhered to the upper surface of the second layer, the base sheet comprising a modified bitumen material.

8. The roofing system of claim 1, further comprising a layer of a vapor retardant material positioned between the roof deck and the first insulation layer.

9. The roofing system of claim 1, wherein the membrane comprises a two-ply modified bitumen material including a base sheet comprising a bituminous asphalt material and a cap sheet applied over the base sheet and comprising a polymeric material.

10. The roofing system of claim 1, wherein the membrane comprises at least one of a thermoplastic polyolefin, an ethylene propylene diene monomer, polyvinyl chloride, or a modified bitumen material.

11. The roofing system of claim 1, wherein the first insulation material and the second insulation material each comprise polyisocyanurate, mineral wool, expanded polystyrene foam, extruded polystyrene foam, or a combination thereof.

12. The roofing system of claim 1, wherein the first layer comprises a thickness of 1 inch to 3.65 inches; and the second layer comprises a thickness of 1 inch to 3.75 inches.

13. The roofing system of claim 1, wherein the first insulation layer and the second insulation layer together are configured to provide a resistance to conductive heat flow through the roofing system having an R-value of at least R30; and further comprising a third insulation layer comprising an additional insulation material positioned along the first insulation layer; wherein the third insulation layer is configured to increase the resistance to conductive heat flow of the roofing system such that the roofing system has an overall resistance to conductive heat flow that is greater than an overall resistance to conductive heat flow of a roofing system including a coverboard.

14. The roofing system of claim 1, wherein the second layer further comprises an additional reinforcing sublayer attached to a lower surface of the substrate; wherein the additional reinforcing sublayer comprises a fiber reinforced material that is different from the fiber reinforced polymer composite material positioned along the upper surface of the substrate.

15. The roofing system of claim 1, wherein the first insulation layer has a first thickness, and the second insulation layer has a second thickness that is greater than the first thickness of the first insulation layer; and wherein the roofing system has a thickness substantially equal to or less than a thickness of a roofing system including a coverboard.

16. The roofing system of claim 1, further comprising at least one sensor coupled to the second insulation layer.

17. A package comprising:

a plurality of insulation panels including reinforced insulation panels;

wherein each of the reinforced insulation panels comprises:

a substrate; and a reinforcing sublayer laminated to, attached to, extruded with or molded with the substrate so as to be integrated with the substrate, wherein the reinforcing sublayer comprises a fiber reinforced polymer composite material;

wherein the fiber reinforced polymer composite material comprises a plurality of glass fibers, carbon fibers, natural fibers, or a combination thereof mixed with a resin;

wherein the reinforced insulation panels are configured to provide a resistance to cracking upon impact of an object thereagainst such that when the reinforced insulation panels are included as part of a roofing system having a first layer of insulation panels positioned along a roof deck, a second layer of the reinforced insulation panels above the first layer of insulation panels, a membrane applied over an upper surface of each of the reinforced insulation panels, and without a coverboard positioned between the membrane and the reinforced insulation panels, the roofing system exceeds requirements for Very Severe Hail Resistance according to FM 4473 VSH Impact Resistance Testing Standard for Impact Resistance Testing Standard for Impact Resistance Testing of Rigid Roofing Materials by Impacting with Freezer Ice Balls.

18. The roofing system of claim 17, wherein the membrane comprises at least one of a thermoplastic polyolefin, an ethylene propylene diene monomer, polyvinyl chloride, or a modified bitumen sheet.

19. The package of claim 17, wherein the reinforced insulation panels further comprise an additional reinforcing sublayer attached to a lower surface of the substrate; wherein the additional reinforcing sublayer comprises a fiber reinforced material that is different from the fiber reinforced polymer composite material positioned along the upper surface of the substrate.

20. The package of claim 17, wherein the substrate comprises polyisocyanurate, mineral wool, expanded polystyrene foam, extruded polystyrene foam, or a combination thereof.

21. The package of claim 17, further comprising a modified bitumen layer configured to attach to an upper surface of each reinforced insulation panel.

22. The package of claim 17, wherein the reinforced insulation panels each further comprise a membrane attached to an upper surface thereof; wherein the membrane comprises a two-ply modified bitumen material including base sheet attached to the fiber reinforced polymer composite material and comprising a bituminous asphalt material, and a cap sheet applied over the base sheet and comprising a weather resistant polymeric material.

23. The package of claim 21, further comprising an adhesive adapted to attach the modified bitumen layer to the reinforcing sublayer of each reinforced insulation panel.

24. The package of claim 17, wherein the reinforced insulation panels each comprise a thickness of 1 inch to 3.75 inches; and wherein the reinforcing sublayer comprises a thickness of 1 mm to 8 mm.

25. The package of claim 17, wherein one or more of the reinforced insulation panels include at least one sensor.

26. The package of claim 25, wherein the at least one sensor comprises one or more sensors adapted to measure temperature, impacts, penetration or leakage of water through the membrane, or a combination thereof.

27. A roofing system, comprising:

a roof deck;

a plurality of first insulation panels positioned above the roof deck, each of the first insulation panels comprising a first insulation material;

a plurality of second insulation panels positioned above the first insulation panels, each of the second insulation panels comprising:

a substrate comprising a second insulation material; and a reinforcing sublayer laminated to, attached to, extruded with or molded with the substrate so as to be integrated with the substrate;

wherein the reinforcing sublayer defines an upper surface of the second insulation panel and comprising a fiber reinforced polymer composite; and a membrane attached to the reinforcing sublayer and configured to withstand exposure to weather;

wherein the fiber reinforced polymer composite comprises a plurality of glass fibers, carbon fibers, natural fibers, or a combination thereof mixed with a resin;

wherein the membrane comprises at least one of a thermoplastic polyolefin, an ethylene propylene diene monomer, polyvinylchloride, or a modified bitumen material including a base comprising a bituminous asphalt material and a cap sheet attached to the base sheet and comprising a polymeric material;

wherein the roofing system does not include an additional layer of coverboards positioned between the roof deck and the membrane.

28. The roofing system of claim 27, wherein the second insulation panels are configured to provide a resistance to cracking upon impact of an object thereagainst such that the roofing system exceeds requirements for Very Severe Hail Resistance according to FM 4473 VSH Impact Resistance Testing Standard for Impact Resistance Testing Standard for Impact Resistance Testing of Rigid Roofing Materials by Impacting with Freezer Ice Balls.

29. The roofing system of claim 27, further comprising a layer of a vapor retardant material positioned between the roof deck and the first insulation panels.

30. The roofing system of claim 27, further comprising an additional reinforcing sublayer attached to a lower surface of the substrate; wherein the additional reinforcing sublayer comprises a fiber reinforced material that is different from the fiber reinforced polymer composite material positioned along the upper surface of the substrate.

31. The roofing system of claim 27, wherein the substrate of the second insulation material comprises polyisocyanurate, mineral wool, expanded polystyrene foam, extruded polystyrene foam, or a combination thereof.

32. A package comprising:

plurality of insulation panels including reinforced insulation panels; wherein each of the reinforced insulation panels comprises:

a substrate comprising an insulation material;

a reinforcing sublayer laminated to, attached to, extruded with or molded with the substrate so as to be integrated with the substrate, the reinforcing sublayer comprising a fiber reinforced polymer composite material; and a membrane comprising at least one of a thermoplastic polyolefin, an ethylene propylene diene monomer, polyvinyl chloride, or a modified bitumen material including a base sheet comprising a bituminous asphalt material and a cap sheet attached to the base sheet and comprising a polymeric material;

wherein the fiber reinforced polymer composite material comprises a plurality of glass fibers, carbon fibers, natural fibers, or a combination thereof mixed with a resin;

wherein the reinforced insulation panels are configured to provide a resistance to cracking upon impact of an object thereagainst such that when the reinforced insulation panels are included as part of a roofing system without a coverboard, the roofing system exceeds requirements for Very Severe Hail Resistance according to FM 4473 VSH Impact Resistance Testing Standard for Impact Resistance Testing Standard for Impact Resistance Testing of Rigid Roofing Materials by Impacting with Freezer Ice Balls.

33. The package of claim 32, wherein the reinforced insulation panels further comprise an additional reinforcing sublayer attached to a lower surface of the substrate; wherein the additional reinforcing sublayer comprises a fiber reinforced material that is different from the fiber reinforced polymer composite material positioned along an upper surface of the substrate.

34. The package of claim 32, wherein the reinforced insulation panels each further comprise a membrane attached to an upper surface thereof; wherein the membrane comprises a two-ply modified bitumen material including base sheet attached to the fiber reinforced polymer composite material and comprising a bituminous asphalt material, and a cap sheet applied over the base sheet and comprising a weather resistant polymeric material.

35. The package of claim 32, wherein the reinforced insulation panels each comprise a thickness of 2 inches to 3.75 inches.

36. The package of claim 32, wherein the substrate comprises polyisocyanurate, mineral wool, expanded polystyrene foam, extruded polystyrene foam, or a combination thereof.

37. The roofing system of claim 1, wherein the reinforcing sublayer comprises a scrim including the plurality of glass fibers, carbon fibers, natural fibers, or combination thereof integrated with a mat of glass fibers and mixed with the resin.

* * * * *